US008403439B2

(12) United States Patent
Tanaka et al.

(10) Patent No.: US 8,403,439 B2
(45) Date of Patent: Mar. 26, 2013

(54) FLOW RATE CONTROL DEVICE, LIQUID-DROPLET EJECTING DEVICE, AND COMPUTER READABLE MEDIUM

(75) Inventors: Kumiko Tanaka, Kanagawa (JP); Jun Isozaki, Kanagawa (JP); Masaki Kataoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 129 days.

(21) Appl. No.: 13/112,190

(22) Filed: May 20, 2011

(65) Prior Publication Data

US 2012/0033003 A1 Feb. 9, 2012

(30) Foreign Application Priority Data

Aug. 9, 2010 (JP) ..... 2010-178888
Feb. 15, 2011 (JP) ..... 2011-029860

(51) Int. Cl.
*B41J 29/38* (2006.01)

(52) U.S. Cl. ..... 347/6; 347/17; 347/22; 347/35

(58) Field of Classification Search ..... 347/6, 7, 347/14, 17, 19, 20, 22, 35, 84–87, 92–94
See application file for complete search history.

(56) References Cited

U.S. PATENT DOCUMENTS

| | | | | |
|---|---|---|---|---|
| 6,179,406 | B1 | 1/2001 | Ito et al. | |
| 6,302,516 | B1 * | 10/2001 | Brooks et al. | 347/35 |
| 7,543,923 | B2 * | 6/2009 | McNestry | 347/85 |
| 7,699,451 | B2 * | 4/2010 | Nishida | 347/85 |

FOREIGN PATENT DOCUMENTS

| | | |
|---|---|---|
| JP | 3-184872 | 8/1991 |
| JP | 2000-052566 | 2/2000 |
| JP | 2005-349843 | 12/2005 |

* cited by examiner

*Primary Examiner* — Juanita D Jackson
(74) *Attorney, Agent, or Firm* — Fildes & Outland, P.C.

(57) ABSTRACT

A flow rate control device includes a pressure generating unit that delivers a liquid to a liquid reservoir unit including an ejecting port; a flow rate control unit that controls a flow rate of the pressure generating unit by performing a first flow rate control and a second flow rate control, the first flow rate control being to raise a pressure inside the liquid reservoir unit up to a target pressure at a first pressure change rate which is sufficiently high to float air bubbles adhering to a wall surface inside the liquid reservoir unit, the second flow rate control being to maintain the target pressure or to lower the pressure inside the liquid reservoir unit from the target pressure at a second pressure change rate lower than the first pressure change rate in order to eject air bubbles floating inside the liquid reservoir unit from the ejecting port.

18 Claims, 35 Drawing Sheets

BACK PRESSURE DIFFERENCE IN NOZZLE SURFACE $\Delta P = (Pout + hout \times g \times \rho) - (Pin + hin \times g \times \rho)$ BACK PRESSURE IN NOZZLE SURFACE $Pnzl = (Pin + hin \times g \times \rho + Pout + hout \times g \times \rho) / 2$

FIG. 8

118

ROM

| CIRCULATION MODE / VALVE NAME | PRESSURIZATION PURGE MODE | | | | | | | | |
|---|---|---|---|---|---|---|---|---|---|
| | INITIAL SETTING | PROCESS 1 | PROCESS 2 | PROCESS 3 | PROCESS 4 | PROCESS 5 | PROCESS 6 | PROCESS 7 | PROCESS 8 |
| SUPPLY-SIDE VALVE 22 | CLOSED | CLOSED | CLOSED | CLOSED | OPENED | OPENED | OPENED | OPENED | CLOSED |
| RECOVERY-SIDE VALVE 26 | CLOSED | CLOSED | CLOSED | CLOSED | CLOSED | CLOSED | CLOSED | CLOSED | CLOSED |
| FIRST COMMUNICATING VALVE 36 | CLOSED | CLOSED | CLOSED | CLOSED | CLOSED | OPENED | OPENED | CLOSED | CLOSED |
| SECOND COMMUNICATING VALVE 38 | CLOSED | CLOSED | CLOSED | CLOSED | CLOSED | OPENED | OPENED | CLOSED | CLOSED |
| SUPPLY-SIDE AIR VALVE 66 | CLOSED | OPENED | CLOSED | CLOSED | CLOSED | CLOSED | CLOSED | CLOSED | CLOSED |
| RECOVERY-SIDE AIR VALVE 88 | CLOSED | OPENED | CLOSED | CLOSED | CLOSED | CLOSED | CLOSED | CLOSED | CLOSED |
| SUPPLY-SIDE DRAIN VALVE 70 | CLOSED | CLOSED | OPENED | CLOSED | CLOSED | CLOSED | CLOSED | OPENED | CLOSED |
| RECOVERY-SIDE DRAIN VALVE 92 | CLOSED | CLOSED | CLOSED | CLOSED | CLOSED | CLOSED | CLOSED | CLOSED | CLOSED |

FIG. 13

118

ROM

| CIRCULATION MODE / VALVE NAME | PRESSURIZATION PURGE MODE | | | | | | |
|---|---|---|---|---|---|---|---|
| | INITIAL SETTING | PROCESS 1 | PROCESS 2 | PROCESS 3 | PROCESS 4 | PROCESS 5 | PROCESS 6 |
| SUPPLY-SIDE VALVE 22 | CLOSED | CLOSED | CLOSED | OPENED | OPENED | OPENED | CLOSED |
| RECOVERY-SIDE VALVE 26 | CLOSED | CLOSED | CLOSED | OPENED | OPENED | OPENED | CLOSED |
| FIRST COMMUNICATING VALVE 36 | CLOSED | CLOSED | CLOSED | CLOSED | CLOSED | CLOSED | CLOSED |
| SECOND COMMUNICATING VALVE 38 | CLOSED | CLOSED | CLOSED | CLOSED | CLOSED | CLOSED | CLOSED |
| SUPPLY-SIDE AIR VALVE 66 | CLOSED | OPENED | CLOSED | CLOSED | CLOSED | CLOSED | CLOSED |
| RECOVERY-SIDE AIR VALVE 88 | CLOSED | OPENED | CLOSED | CLOSED | CLOSED | CLOSED | CLOSED |
| SUPPLY-SIDE DRAIN VALVE 70 | CLOSED | CLOSED | OPENED | CLOSED | CLOSED | OPENED | CLOSED |
| RECOVERY-SIDE DRAIN VALVE 92 | CLOSED | CLOSED | OPENED | CLOSED | CLOSED | OPENED | CLOSED |

FIG. 16

118

ROM

| CIRCULATION MODE / VALVE NAME | PRESSURIZATION PURGE MODE | | | | | | |
|---|---|---|---|---|---|---|---|
| | INITIAL SETTING | PROCESS 1 | PROCESS 2 | PROCESS 3 | PROCESS 4 | PROCESS 5 | PROCESS 6 |
| SUPPLY-SIDE VALVE 22 | CLOSED | CLOSED | CLOSED | OPENED | OPENED | OPENED | CLOSED |
| RECOVERY-SIDE VALVE 26 | CLOSED | CLOSED | CLOSED | OPENED | OPENED | OPENED | CLOSED |
| FIRST COMMUNICATING VALVE 36 | CLOSED | CLOSED | CLOSED | CLOSED | CLOSED | CLOSED | CLOSED |
| SECOND COMMUNICATING VALVE 38 | CLOSED | CLOSED | CLOSED | CLOSED | CLOSED | CLOSED | CLOSED |
| SUPPLY-SIDE AIR VALVE 66 | CLOSED | OPENED | CLOSED | CLOSED | CLOSED | CLOSED | CLOSED |
| RECOVERY-SIDE AIR VALVE 88 | CLOSED | OPENED | CLOSED | CLOSED | CLOSED | CLOSED | CLOSED |
| SUPPLY-SIDE DRAIN VALVE 70 | CLOSED | CLOSED | OPENED | CLOSED | CLOSED | OPENED | CLOSED |
| RECOVERY-SIDE DRAIN VALVE 92 | CLOSED | CLOSED | OPENED | OPENED | OPENED | OPENED | CLOSED |

FLOW RATE CONTROL DEVICE, LIQUID-DROPLET EJECTING DEVICE, AND COMPUTER READABLE MEDIUM

CROSS-REFERENCE TO RELATED APPLICATIONS

This application is based on and claims priority under 35 USC 119 from Japanese Patent Applications No. 2010-178888 filed Aug. 9, 2010 and No. 2011-029860 filed Feb. 15, 2011.

BACKGROUND

Technical Field

The present invention relates to a flow rate control device, a liquid-droplet ejecting device, and a computer readable medium storing a flow rate control program.

SUMMARY

According to an aspect of the invention, there is provided a flow rate control device that includes: a pressure generating unit that delivers a liquid to a liquid reservoir unit including an ejecting port; and a flow rate control unit that controls the flow rate of the pressure generating unit by performing a first flow rate control and a second flow rate control, the first flow rate control being to raise a pressure inside the liquid reservoir unit up to a target pressure at a first pressure change rate which is sufficiently high to float air bubbles adhering to a wall surface inside the liquid reservoir unit, and the second flow rate control being to maintain the target pressure or to lower the pressure inside the liquid reservoir unit from the target pressure at a second pressure change rate which is lower than the first pressure change rate in order to eject air bubbles floating inside the liquid reservoir unit from the ejecting port.

BRIEF DESCRIPTION OF THE DRAWINGS

Exemplary embodiments of the present invention will be described in detail based on the following figures, wherein:

FIG. 8 is a conceptual diagram of a ROM in which a process-valve opening and closing pattern table according to the present exemplary embodiment is stored;

FIG. 13 is a conceptual diagram of a ROM in which a process-valve opening and closing pattern table according to Modification 3 of the present exemplary embodiment is stored;

FIG. 16 is a conceptual diagram of a ROM in which a process-valve opening and closing pattern table according to Modification 4 of the present exemplary embodiment is stored;

DETAILED DESCRIPTION

[First Embodiment]

(Overall Configuration)

In the present exemplary embodiment, as one example of a liquid-droplet ejecting device that ejects liquid droplets, an ink-jet recording device that ejects ink droplets to record an image on a recording medium will be described.

The liquid-droplet ejecting device is not limited to the ink-jet recording device. As the liquid-droplet ejecting device, for example, a color filter manufacturing device that ejects ink or the like on a film or glass to manufacture a color filter, a device that ejects an organic EL solution on a substrate to form an EL display panel, a device that ejects solder in a molten state on a substrate to form a bump for mounting components, and a device that ejects liquid including metal to form a wiring pattern, and various film forming devices that each ejects liquid droplets to form a film may be cited, and in sum, devices that each ejects liquid droplets may be cited.

Figure 18:
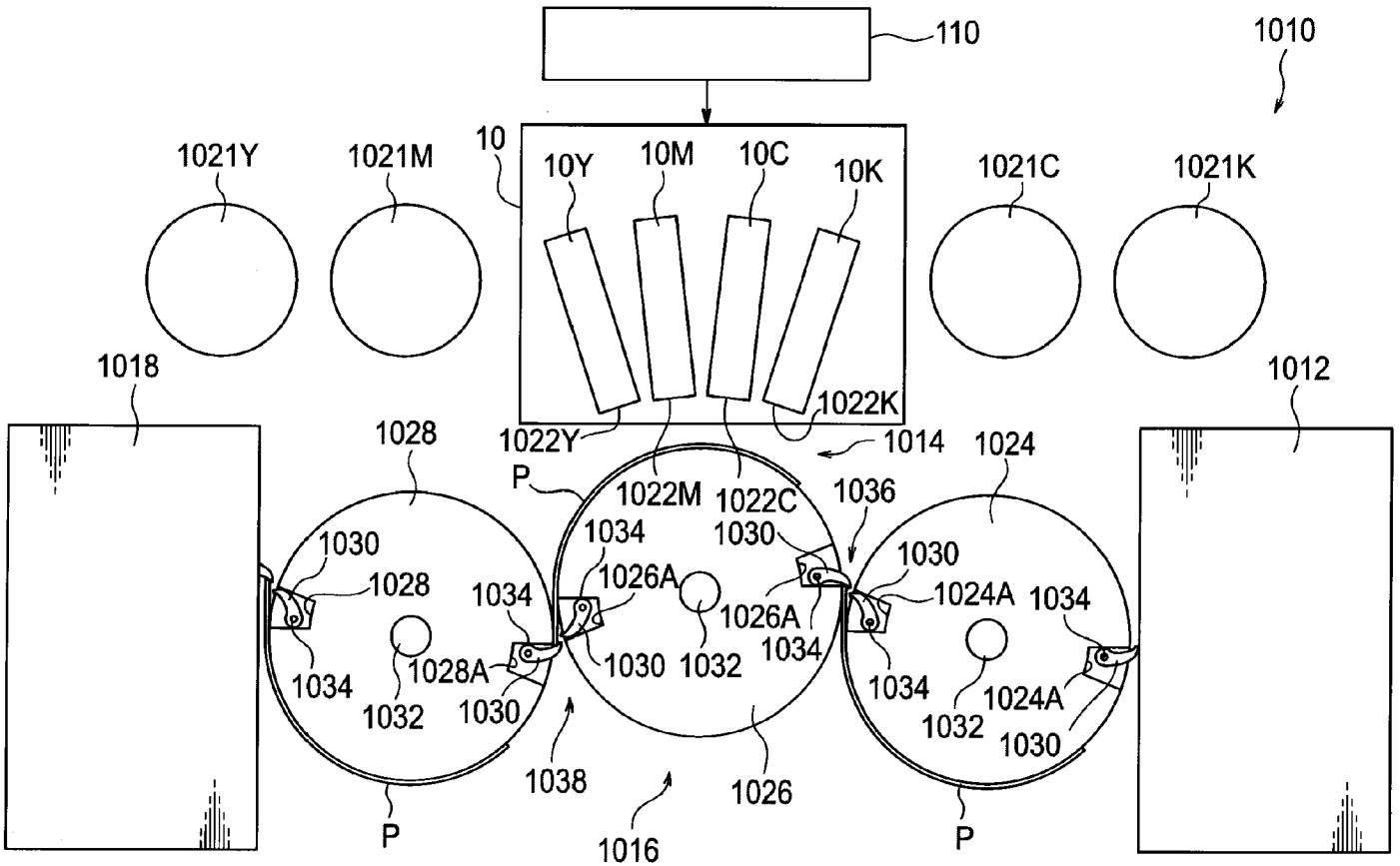
FIG. 18 is a schematic diagram showing a configuration of an ink jet recording device according to the present exemplary embodiment.

FIG. 18 is a schematic view showing a configuration of an ink jet recording device according to the present exemplary embodiment.

As shown in FIG. 18, an ink-jet recording device 1010 includes a recording-medium containing unit 1012 in which a recording medium P such as paper is contained, an image recording unit 1014 that records an image on the recording medium P, a conveyance unit 1016 that conveys the recording medium P from the recording-medium containing unit 1012 to the image recording unit 1014, and a recording-medium ejecting unit 1018 that ejects the recording medium P on which the image is recorded by the image recording unit 1014.

The image recording unit 1014 includes liquid-droplet ejecting devices (hereinafter, referred to as "ink-jet heads") 10Y, 10M, 10C, 10K that eject ink droplets to record the image on the recording medium as one example of liquid-droplet ejecting heads that eject liquid droplets. The ink jet heads 10Y, 10M, 10C, 10K may be collectively referred to as "ink-jet heads 10Y to 10K". Moreover, a section including these ink jet heads 10Y to 10K and piping for circulating ink may be referred to as an "ink-jet head 10".

In the ink-jet head 10, the ejecting of the ink is controlled by an ink-supply control device 110.

The ink jet heads 10Y to 10K each include ink head modules 12 (refer to FIG. 1) as plural liquid droplet ejecting units, and the ink head modules 12 respectively have nozzle surfaces 1022Y to 1022K, in each of which nozzles (not shown) are formed. These nozzle surfaces 1022Y to 1022K each have a recordable region having a width nearly equal to, or larger than a maximum width of the recording medium P, in which image recording in the ink jet recording device 1010 is assumed.

Furthermore, the ink jet heads 10Y to 10K are arrayed in parallel in the color order of yellow (Y), magenta (M), cyan (C), and black (K) from the downstream side in a conveyance direction of the recording medium P, and ink droplets corresponding to the respective colors are ejected from the plural nozzles by a piezoelectric method to record the image. In the ink-jet heads 10Y to 10K, the configuration to eject the ink droplets may also be such that the ink droplets are ejected by another method such as a thermal method.

In the jet recording device 1010, ink tanks 1021Y, 1021M, 1021C, 1021K reserving inks in the respective colors (hereinafter, referred to as 1021Y to 1021K) are provided as reservoir units that reserve liquid. The inks are supplied to the respective ink jet heads 10Y to 10K from these ink tanks 1021Y to 1021K. As the inks supplied to the ink jet heads 10Y to 10K, various types of inks such as water-based ink, oil-based ink, and solvent-based ink may be used.

The conveyance unit 1016 has a taking-out drum 1024 that takes out the recording medium P inside the recording-medium containing unit 1012 one by one, a conveyance drum 1026 as a conveyance body that conveys the recording medium P to the ink jet heads 10Y to 10K of the image recording unit 1014 to cause a recording surface (front surface) to face the ink jet heads 10Y to 10K, and a sending-out drum 1028 that sends out, to the recording-medium ejecting unit 1018, the recording medium P on which the image is recorded. The taking-out drum 1024, the conveyance drum 1026, and the sending-out drum 1028 are each configured so that the recording medium P is held on each circumferential surface thereof by an electrostatic adsorption unit or a non-electrostatic adsorption unit using suction, adhesion or the like.

Moreover, in each of the taking-out drum 1024, the conveyance drum 1026, and the sending-out drum 1028, for example, two pairs of grippers 1030 as holding units that pinch and hold a downstream end portion in the conveyance direction of the recording medium P, and in this case, up to two sheets of recording mediums P can be held by the grippers 1030 on each of the circumferential surfaces of these three drums 1024, 1026, 1028. The grippers 1030 are provided inside two depressed portions 1024A, 1026A, 1028A formed in the circumferential surface of each of the drums 1024, 1026, 1028.

Specifically, rotary shafts 1034 are supported along rotary shafts 1032 of the respective drums 1024, 1026, 1028 at predetermined positions inside the depressed portions 1024A, 1026A, 1028A of the respective drums 1024, 1026, 1028, and to these rotary shafts 1034 are fixed the plural grippers 1030 at intervals in an axial direction. Accordingly, the rotary shafts 1034 rotate in both normal and reverse directions by an actuator not shown, by which the grippers 1030 are rotated in both the normal and reverse directions along a circumferential direction of the respective drums 1024, 1026, 1028, so that the downstream end portion in the conveyance direction of the recording medium P is pinched and held, or is released.

That is, the grippers 1030 rotate so that fore-end portions thereof slightly project from the circumferential surfaces of the respective drums 1024, 1026, 1028, by which at a delivery position 1036 where the circumferential surface of the taking-out drum 1024 and the circumferential surface of the conveyance drum 1026 face each other, the recording medium P is delivered from the grippers 1030 of the taking-out drum 1024 to the grippers 1030 of the conveyance drum 1026, and at a delivery position 1038 where the circumferential surface of the conveyance drum 1026 and the circumferential surface of the sending-out drum 1028 face each other, the recording medium P is delivered and received from the grippers 1030 of the conveyance drum 1026 to the grippers 1030 of the sending-out drum 1028.

Moreover, the inkjet recording device 1010 includes a maintenance unit (not shown) that maintains the inkjet heads 10Y to 10K. The maintenance unit has a cap covering the nozzle surfaces of the ink jet heads 10Y to 10K, a receiving member that receives liquid droplets ejected preliminarily (ejected idly), a cleaning member that cleans the nozzle surfaces, a suction device to suck the ink in the nozzles, and the like, and the maintenance unit moves to a position opposed to the ink jet heads 10Y to 10K to perform various kinds of maintenance.

Next, image recording operation of the ink jet recording device 1010 will be described.

The recording medium P taken out one by one from the recording-medium containing unit 1012 by the grippers 1030 of the taking-out drum 1024 and held thereby is conveyed while being adsorbed onto the circumferential surface of the tacking-out drum 1024, and is delivered from the grippers 1030 of the taking-out drum 1024 to the grippers 1030 of the conveyance drum 1026 at the delivery position 1036.

The recording medium P held by the grippers 1030 of the conveyance drum 1026 is conveyed to an image recording position of the ink jet heads 10Y to 10K while being adsorbed by the conveyance drum 26, and the image is recorded on the recording surface by the ink droplets ejected from the ink-jet heads 10Y to 10K.

The recording medium P on the recording surface of which the image has been recorded is delivered from the grippers 1030 of the conveyance drums 1026 to the grippers 1030 of the sending-out drums 1028 at the delivery position 1038. The recording medium P held by the grippers 1030 of the sending-out drum 1028 is conveyed while being adsorbed by the sending-out drum 1028, and is ejected to the recording-medium ejecting unit 1018. As described above, a series of image recording operation is performed.

(Piping Configuration)

Figure 1:
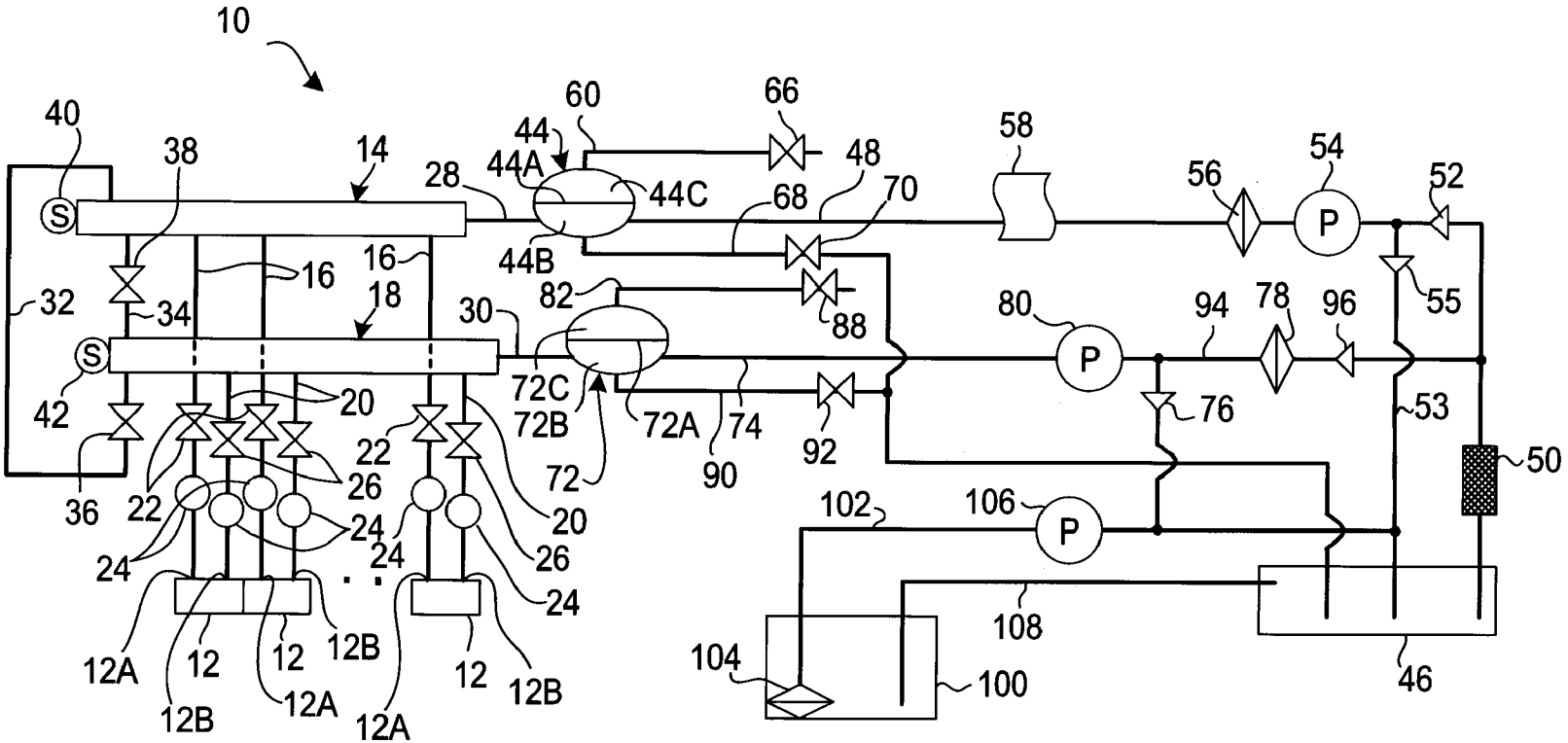
FIG. 1 is a piping diagram of an ink jet head of an ink jet printer according to the present exemplary embodiment.

FIG. 1 shows a piping diagram of the ink-jet head 10 of an ink-jet printer as one example of the liquid-droplet ejecting device according to the present exemplary embodiment.

In the ink jet head 10 of the present exemplary embodiment, the plural head modules 12 are attached, and ink-circulation piping paths to supply the ink to the respective head modules 12 are formed.

As shown in FIG. 1, each of the head modules 12 is provided with an input port 12A into which the ink flows by supply operation, and an output port 12B that ejects the ink by recovery operation. To the input port 12A is attached a fore-end of a supply-side branched pipe 16 branched from a supply-side manifold 14, and to the output port 12B is attached a fore-end of a recovery-side branched pipe 20 branched from a recovery-side manifold 18. That is, the structure is such that in the supply-side manifold 14 and the recovery-side manifold 18, the branched pipes corresponding to an installation number of the head modules 12 (the supply-side branched pipes 16 and the recovery-side branched pipes 20) are provided, and the ink supplied to the supply-side manifold 14 is supplied to each of the head modules 12 at a predetermined pressure Pin and at a predetermined flow rate, and further, the ink supplied to each of the head modules 12 is recovered from the relevant head module 12 to the recovery-side manifold 18 at a predetermined pressure Pout and at a predetermined flow rate.

That is, a differential pressure ΔP is produced in the head modules 12 by the pressure Pin of the supply-side manifold 14 and the pressure Pout of the recovery-side manifold 18, and as a result, inside each of the head modules 12, a flow of the ink occurs between the input port 12A and the output port 12B, which flow allows the fresh ink to be constantly supplied to the head module 12. A back pressure Pnz1, which is an average pressure of summation, is applied to the nozzle surfaces as ink ejecting ports in view of influence by the difference between the pressure Pin of the supply-side manifold 14 and the pressure Pout of the recovery-side manifold 18.

In each of the supply-side branched pipes 16, the supply-side valve 22 and a buffer 24 are interposed. Moreover, in each of the recovery-side branched pipes 20, a recovery-side valve 26 and the buffer 24 are interposed. The supply-side valves 22 and the recovery-side valves 26 are operated so as to be opened or closed when the head modules 12 need to be operated individually. The buffers 24 each have a role of buffering pressure fluctuation and the like while the ink supplied from the supply-side manifold 14 or the ink recovered to the recovery-side manifold 18 is flowing.

One end portion of a supply pipe 28 of an ink-circulation piping system is attached to one end portion in a longitudinal direction (right end portion in FIG. 1) of the supply-side manifold 14, while one end portion of a recovery pipe 30 of the ink-circulation piping system is attached to one end portion in the longitudinal direction (right end portion in FIG. 1) of the recovery-side manifold 18.

Moreover, a first communicating flow path 32 and a second communicating flow path 34 are provided between other end portions (left end portions in FIG. 1) of the supply-side manifold 14 and the recovery-side manifold 18. In the first communicating flow path 32, a first communicating valve 36 is interposed. In the second communicating flow path 34, a second communicating valve 38 is interposed. This first communicating flow path 32 and the second communicating flow path 34 are used for pressure and flow rate adjustment between the supply-side manifold 14 and the recovery-side manifold 18, and the like. For example, in normal circulation (a flow from the supply-side manifold 14 to the recovery-side manifold 18), the first communicating valve 36 is closed and the second communicating valve 38 is opened, so that only the second communicating flow path 38 is communicated.

Furthermore, in the other end portions of the supply-side manifold 14 and the recovery-side manifold 18, a supply-side pressure sensor 40 and a recovery-side pressure sensor 42 are attached respectively to monitor pressures of the ink flowing in the supply-side manifold 14 and the recovery-side manifold 18.

Another end portion of the supply pipe 28 joined to the supply-side manifold 14 is joined to a supply-side sub tank 44. The supply-side sub tank 44 has a two-chamber structure and is partitioned by an elastic thin-film member 44A, one of which is a sub tank chamber for ink 44B and the other of which is an air chamber 44C.

One end portion of a supply-side main pipe 48 to bring in the ink from a buffer tank 46 is joined to the sub tank chamber for ink 44B. An opening at another end of the supply-side main pipe 48 is soaked in the ink reserved in the buffer tank 46.

In the supply-side main pipe 48, a deaeration module 50, a one-way valve 52, a supply-side pump 54 (one example of a pressure generating unit), a supply-side filter 56, and an ink temperature regulator 58 are interposed in the order from the buffer tank 46 to the supply-side sub tank 44. With a driving force of the supply-side pump 54, air bubbles are removed from the ink and a temperature of the ink is regulated in the process of supplying the ink reserved in the buffer tank 46 to the supply-side sub tank 44.

Aside from the supply main pipe 48, one end portion of a branched pipe 53 is communicated with an inlet of the supply-side pump 54, and another opening of this branched pipe 53 is soaked in the ink reserved in the buffer tank 46 through a one-way valve 55.

Moreover, while the supply-side pump 54 applied in the present exemplary embodiment is a tube pump using a stepping motor (the ink is supplied into a tube while squeezing the elastic tube by rotary driving by the stepping motor), the present invention is not particularly limited to the above-described pump. Hereinafter, when a number of rotations of the pump is referred to, it is equivalent to a number of rotations of the stepping motor.

An open pipe 60 is attached to the air chamber 44C of the supply-side sub tank 44. In the open pipe 60, a supply-side air valve 66 is interposed.

Moreover, one end of a drain pipe 68 is joined to the sub tank chamber for ink 44B. An opening of another end of the drain pipe 68 is soaked in the ink reserved in the buffer tank 46. In the drain pipe 68, a supply-side drain valve 70 is interposed.

The above-described supply-side sub tank 44 has a role of maintaining an inside of the sub tank chamber for ink 44B at a negative pressure by the air chamber 44C and the thin-film member 44A.

Next, another end portion of the recovery pipe 30 joined to the recovery-side manifold 18 is joined to a recovery-side sub tank 72. The recovery-side sub tank 72 has a two-chamber structure and is partitioned by an elastic thin-film member 72A, one of which is a sub tank chamber for ink 72B and the other of which is an air chamber 72C.

One end portion of a recovery-side main pipe 74 to bring the ink into the buffer tank 46 is joined to the sub tank chamber for ink 72B.

In the recovery-side main pipe 74, a one-way valve 76 is interposed, and with a driving force of a recovery-side pump 80 (one example of the pressure generating unit), the ink inside the recovery-side sub tank 72 is recovered to the buffer tank 46.

An open pipe 82 is attached to the air chamber 72C of the recovery-side sub tank 72. In the open pipe 82, a recovery-side air valve 88 is interposed.

Moreover, one end of a drain pipe 90 is joined to the sub tank chamber for ink 72B. Another end of the drain pipe 90 is communicated with the drain pipe 68 of the supply-side sub tank 44 through a recovery-side drain valve 92.

The above-described recovery-side sub tank 72 has a role of maintaining an inside of the sub tank chamber for ink 72B at a negative pressure by the air chamber 72C and the thin-film member 72A.

In the present exemplary embodiment, with the pressures by the supply-side pump 54 and the recovery-side pump 80, the pressure Pin of the supply-side manifold 14>the pressure Pout of the recovery-side manifold 18, each of which is supplied as a negative pressure. That is, since the supply pressure of the supply-side pump 54 is a negative pressure, and the recovery pressure of the recovery-side pump 80 is a larger negative pressure, the ink flows from the supply-side manifold 14 to the recovery-side manifold 18, and the back pressure Pnz1 of the nozzles of the head modules 12 is maintained at a negative pressure ({(Pin+Pout)/2+ρg(hin+hout)/2}, where ρ is an ink density, hin is a height from the nozzle surfaces to the supply-side manifold 14, and hout is a height from the nozzle surfaces to the recovery-side manifold 18).

In the present exemplary embodiment, piping 94 for pressurization purge inside the head modules 12 is provided, which piping communicates between an entry side of the recovery-side pump 80 and an exit side of the deaeration module 50 in the supply-side main pipe 48.

In the piping for pressurization purge 94, a one-way valve 96 and a recovery-side filter 98 are interposed in the order from the deaeration module 50 to the recovery-side pump 80.

That is, when the insides of the head modules 12 are pressurized to eject the ink at a burst, thereby eliminating the air bubbles and the like, in addition to the driving of the supply-side pump 54, a driving direction of the recovery-side pump 80 is reversed to that at the normal time to supply the ink from the buffer tank 46 to the recovery-side manifold 18. During the ejection, the drain pipes 68, 90 are used.

The buffer tank 46 is communicated with a main tank 100. That is, in the buffer tank 46, an ink amount required to circulate the ink is reserved, and in accordance with the ink consumption, the ink is replenished from the main tank 100. That is, one end portion of a replenishing pipe 102 is soaked in the ink reserved in the main tank 100. A filter 104 is attached to a soaked one-end opening of this replenishing pipe 102. The replenishing pipe 102 is joined to an entry side of a replenishing pump 106. An exit side of the replenishing pump 106 is communicated with a middle portion of the piping 94 for pressurization purge arranged toward the buffer tank 46. Driving the replenishing pipe 106 allows the ink to be replenished into the buffer tank 46. An overflow pipe 108 is provided between the buffer tank 46 and the main tank 100 to return the ink to the main tank 100 at the time of excessive replenishment.

(Control System Configuration)

Figure 2:
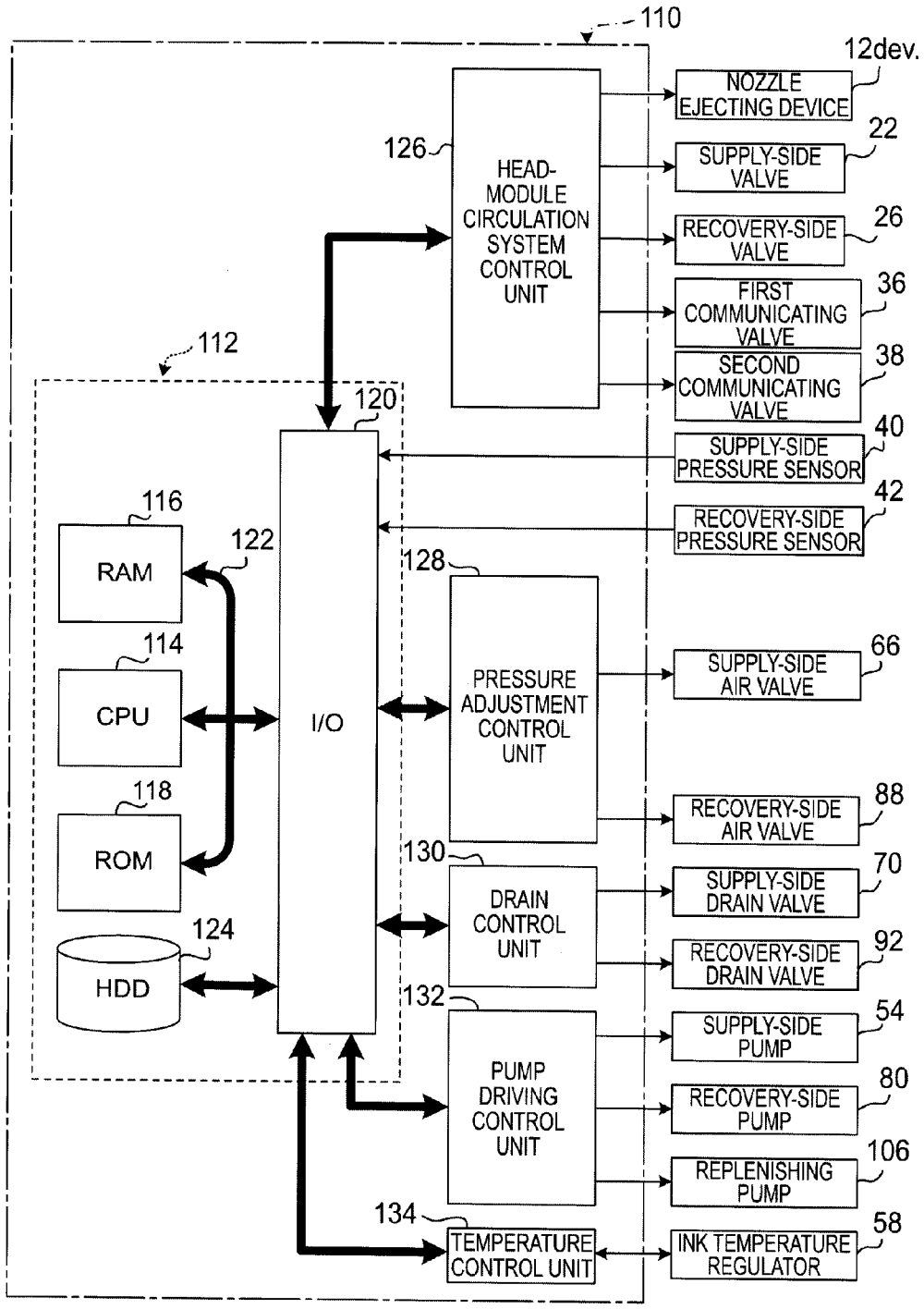
FIG. 2 is a block diagram of an ink-supply control device to control operation in the ink jet head according to the present exemplary embodiment.

FIG. 2 shows a block diagram of the ink-supply control device 110 to control operation in the ink jet head 10 according to the present exemplary embodiment.

The ink-supply control device 110 includes a microcomputer 112. The microcomputer 112 includes a CPU 114, a RAM 116, a ROM 118, an I/O 120, and a bus 122 connecting these, such as a data bus and a control bus.

A hard disk drive (HDD) 124 is connected to the I/O 120. Moreover, the supply-side pressure sensor 40 and the recovery-side pressure sensor 42 are connected to the I/O 120.

Furthermore, although the illustration is omitted, image data when the ink is ejected from the nozzles of the head modules 12 to form the image is input to the I/O 120. The image data may be in a status where ink ejecting positions and ejecting amounts are decided (raster data), or may be data compressed, such as JPEG. In this case, in the CPU 114, the data is converted to data for ink ejecting (raster data). In the CPU 114, ink circulation system programs stored in the ROM 118 are read to be executed. In the ROM 118, at least the following control programs are stored as ink circulation modes.

(First Ink Circulation Mode)

A circulation control program to cause the ink inside the buffer tank 46 to flow from the supply-side manifold 14 to the recovery-side manifold 18 so as to circulate the same (a program 1).

(Second Ink Circulation Mode)

A circulation control program to eject (purge) air bubbles occurring inside the head modules 12 (a program 2).

The storage of the programs to execute the above-described first ink circulation mode and second ink circulation mode are not limited to that in the ROM 118, but the programs may be stored in the HDD 124 or an external storage medium so as to be acquired from a reader that reads information by loading the external storage medium or from a network such as a LAN (both are not shown).

In the CPU 114, the ink-circulation control program is read, and based on the read ink-circulation control program, a head-module circulation system control unit 126, a pressure adjustment control unit 128, a drain control unit 130, a pump driving control unit 132, and a temperature control unit 134 that are connected to the I/O 120 operate.

To the head-module circulation system control unit 126 are connected a nozzle ejecting device 12 dev. (e.g., a device that operates so as to eject the ink droplets from the nozzles by oscillation of a pressure chamber by conduction control over a piezoelectric element and the like), which is included in each of the head modules 12, the supply-side valves 22, the recovery-side valves 26, the first communicating valve 36, and the second communicating valve 38.

To the pressure adjustment control unit 128 are connected the supply-side air valve 66 and the recovery-side air valve 88.

To the drain control unit 130 are connected the supply-side drain valve 70 and the recovery-side drain valve 92.

Hereinafter, the supply-side valves 22, the recovery-side valves 26, the first communicating valve 36, the second communicating valve 38 and the supply-side air valve 66, the recovery-side air valve 88, the supply-side drain valve 70, and the recovery-side drain valve 92 may be collectively referred to as the "respective valves".

To the pump driving control unit 132 are connected the supply-side pump 54, the recovery-side pump 80, and the replenishing pump 106. While in the present exemplary embodiment, rotary speeds of the supply-side pump 54, the recovery-side pump 80 and the replenishing pump 106 are each expressed by a number of rotations (rpm), another expression such as a linear speed and angular speed may be employed.

To the temperature control unit 134 is connected the ink temperature regulator 58.

Figure 3:
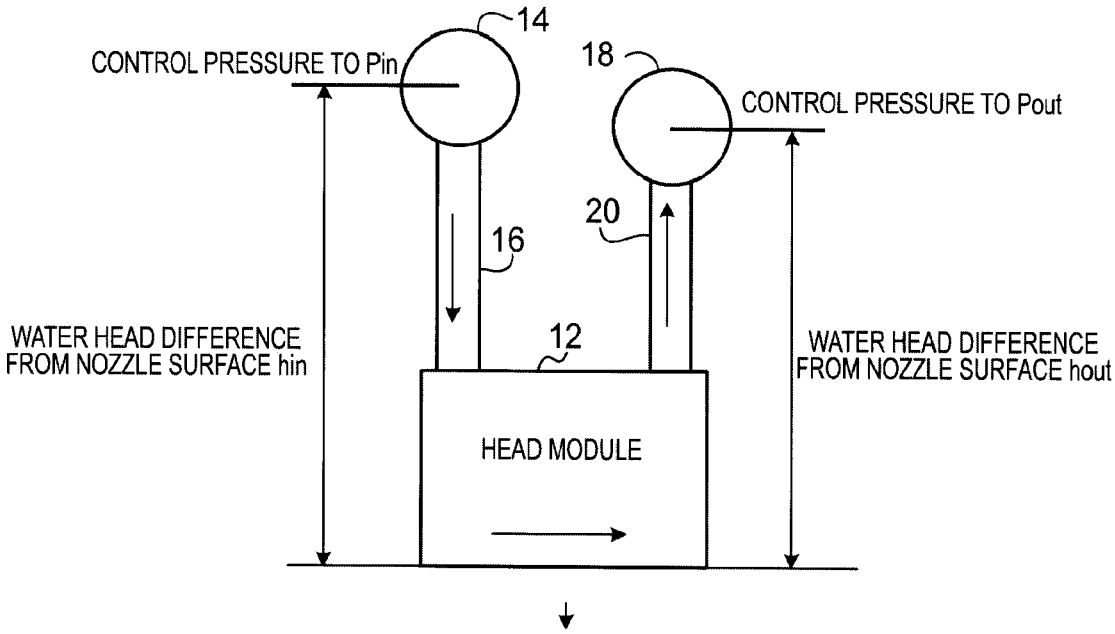
FIG. 3 is a schematic side diagram to show a pressure relationship between a supply-side manifold and a recovery-side manifold according to the present exemplary embodiment.

FIG. 3 shows overviews of this differential pressure ΔP and the back pressure Pnz1.

As shown in FIG. 3, there is a difference between a height position of the supply-side manifold 14 and a height position of the recovery-side manifold 18 with respect to the head modules 12. Accordingly, a water head difference between the supply-side manifold 14 and each of the nozzle surfaces of the head modules 12, and a water head difference between the recovery-side manifold 18 and the nozzle surface of the head module 12 are also different. Here, the water head difference between the supply-side manifold 14 and the nozzle surface is hin [mm], and the water head difference between the recovery-side manifold 18 and the nozzle surface is hout [mm].

The ink is supplied to the supply-side manifold 14 at the predetermined pressure Pin with the driving force of the supply-side pump 54, and the ink is supplied to the recovery-side manifold 18 at the predetermined pressure Pout with the driving force of the recovery-side pump 80. The pressure Pin and the pressure Pout at this time are both negative pressures, and the pressure Pout is a larger negative pressure than the pressure Pin.

Under the above-described conditions, the back pressure Pnz1 in the nozzle surface of the head module 12 is expressed by the following formula (1).

Moreover, the differential pressure ΔP between the supply side and the recovery side is expressed by the following formula (2).

$$Pnz1=(Pin+hin\times g\times\rho+Pout+hout\times g\times\rho)/2 \quad (1)$$

$$\Delta P=(Pout+hout\times g\times\rho)-(Pin+hin\times g\times\rho) \quad (2)$$

where Pnzl: a pressure in the nozzle surface of the head module 12 (back pressure)

Pin: a pressure inside the supply-side manifold 14

Pout: a pressure inside the recovery-side manifold 18 g: a gravity acceleration

ρ: an ink density.

In the above-described formulae (1) and (2), the water head difference hin, hout and the gravity acceleration g are considered to be constants, and when the ink is not changed, the ink density ρ is also considered to be a constant. Accordingly, the adjustment of the differential pressure ΔP and the back pressure Pnz1 depends on the pressure Pin inside the supply-side manifold 14 and the pressure Pout inside the recovery-side manifold 18.

An inner space provided in each of the head modules 12 having the above-described configuration (hereinafter, may be referred to as a "reservoir space", or "inside the head module") is filled with the ink. The air bubbles may be mixed into this ink. The air bubbles cause variation in the pressure inside the reservoir space, and for example, a liquid droplet amount from the nozzles at the time of the liquid droplet ejecting control may be varied, so that the air bubbles need to be removed.

Thus, in the present exemplary embodiment, a pressurization purge function is included in the ink-circulation piping paths. The basic control of the pressurization purge is to rapidly pressurize the reservoir space inside the head module 12 to eject the air bubbles from the nozzles. In the present exemplary embodiment, particularly, pressure control is made in the reservoir space to suppress the influence of decrease in air bubble ejecting performance, which is caused by rapid pressure decrease after the rapid pressurization.

That is, according to the flow rate control during the driving of the supply-side pump 54 and the recovery-side pump 80, at least two types of pressure change rates are set. The basic procedure is as follows.

(Step 1) The pressure is raised up to a target pressure at the rapid pressure change rate.

(Step 2) After the pressure has reached the target pressure, the pressure is lowered at a more moderate pressure change rate than that in step 1.

The foregoing step 1 mainly has a role of floating the air bubbles adhering to an inner wall of the reservoir space of the head module 12.

Moreover, the foregoing step 2 mainly has a role of ejecting the floating air bubbles from the nozzles of the head module 12.

That is, in the present exemplary embodiment, the above-described at least two-staged pressure adjustment (flow rate control) allows the function of smooth pressurization purge (bubble ejection) function to be realized.

Figure 4:
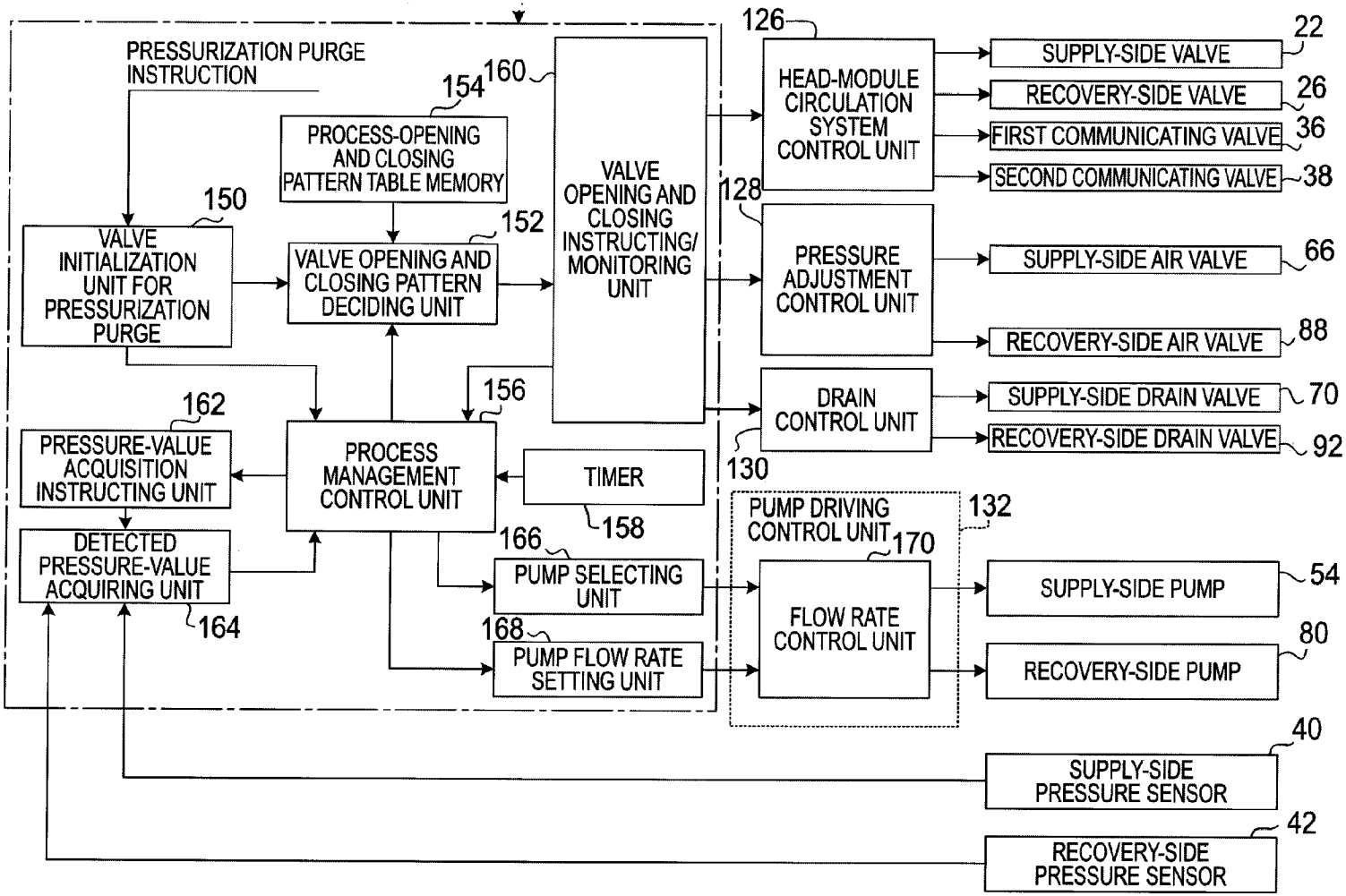
FIG. 4 is a functional block diagram for executing a pressurization purge function in the ink-supply control device according to the present exemplary embodiment.

FIG. 4 shows a functional block diagram for executing the pressurization purge function in the ink-supply control device 110. This functional block diagram is shown by dividing the purge pressure function into functional blocks, and does not limit a hard configuration. For example, in the present exemplary embodiment, the pressurization purge function is mainly executed by a software program by the microcomputer 112 of the ink supply control device 110.

As shown in FIG. 4, a pressurization purge instruction signal is input in a valve initialization unit for pressurization purge 150. The valve initialization unit for pressurization purge 150 is connected to a valve opening and closing pattern deciding unit 152, and when the pressurization purge instruction signal is input, an actuation signal is output to the valve opening and closing pattern deciding unit 152. Upon receiving the actuation signal, the valve opening and closing pattern deciding unit 152 reads initial opening and closing pattern information of the respective valves from a process-opening and closing pattern table memory 154 (refer to FIG. 8).

The valve initialization unit for pressurization purge 150 is connected to a process management control unit 156. The valve initialization unit for pressurization purge 150 outputs the actuation signal to the valve opening and closing pattern deciding unit 152, and also outputs the read signal to the process management control unit 156. Thereby, the process management control unit 156 starts the process management of the pressurization purge.

The process management control unit 156 basically has a role of bringing forward the process with time management by a timer 158, and instructs the process execution to the valve opening and closing pattern deciding unit 152 at the time of execution of the respective processes. In the present exemplary embodiment, processes 1 to 6 are set. In the valve opening and closing pattern deciding unit 152, a valve opening and closing pattern in each of the processes is decided from a process-opening and closing pattern table stored in the process-opening and closing pattern table memory 154, based on process number information input from the process management control unit 156.

The valve opening and closing pattern deciding unit 152 is connected to a valve opening and closing instructing/monitoring unit 160, and an opening and closing instruction signal is output to the head-module circulation system control unit 126, the pressure adjustment control unit 128, and the drain control unit 130 so as to set the decided opening and closing pattern of the respective valves. In the head-module circulation system control unit 126, the pressure adjustment control unit 128, and the drain control unit 130, the valves connected thereto are opened and closed based on the decided opening and closing pattern. In the head-module circulation system control unit 126, the pressure adjustment control unit 128, and the drain control unit 130, the valve opening and closing operations have completed, a signal indicating the completion is sent back to the valve opening and closing instructing/monitoring unit 160.

The valve opening and closing instructing/monitoring unit 160 is connected to the process management control unit 156 so as to notify this process management control unit 156 of the completion of the opening and closing operations of the valves.

The process management control unit 156 is connected to a pressure-value acquisition instructing unit 162 and a detected pressure-value acquiring unit 164. The supply-side pressure sensor 40 and the recovery-side pressure sensor 42 are connected to the detected pressure-value acquiring unit 164. In the process management control unit 156, when at a stage of the process 4, the target pressure is reached with respect to a predetermined flow rate 1, the flow rate is changed to a flow rate 2. Thus, in order to detect the target pressure, during execution of process 4, a pressure-value acquisition instructing signal is output to the pressure-value acquisition instructing unit 162. In accordance with this pressure-value acquisition instructing signal, the pressure-value acquisition instructing unit 162 causes the detected pressure-value acquiring unit 164 to acquire detected pressure values input from the supply-side pressure sensor 40 and the recovery-side pressure sensor 42 and to send out the same to the process management control unit 156.

In the process management control unit 156, during the process 4 (more particularly, until the target pressure is reached), the target pressure and the detected pressure values are compared.

A pump selecting unit 166 and a pump flow rate setting unit 168 are connected to the process management control unit 156 so as to select the pump suitable for each of the processes, and make flow rate setting, and the result is sent out to the pump driving control unit 132.

The pump driving control unit 132 controls the driving of the supply-side pump 54 and/or the recovery-side pump 80, based on information received from the pump selecting unit 166 and the pump flow rate setting unit 168 (pump selection information and flow rate setting information).

At this time, a flow rate control unit 170 controls the flow rate(s) of the selected supply-side pressure pump 54 and/or the recovery-side pressure pump 80 is (are) controlled so as to be maintained at the set flow rate (e.g., feedback control by installing the flow rate sensors and the like).

Hereinafter, operation of the present exemplary embodiment will be described.

Figure 5A:
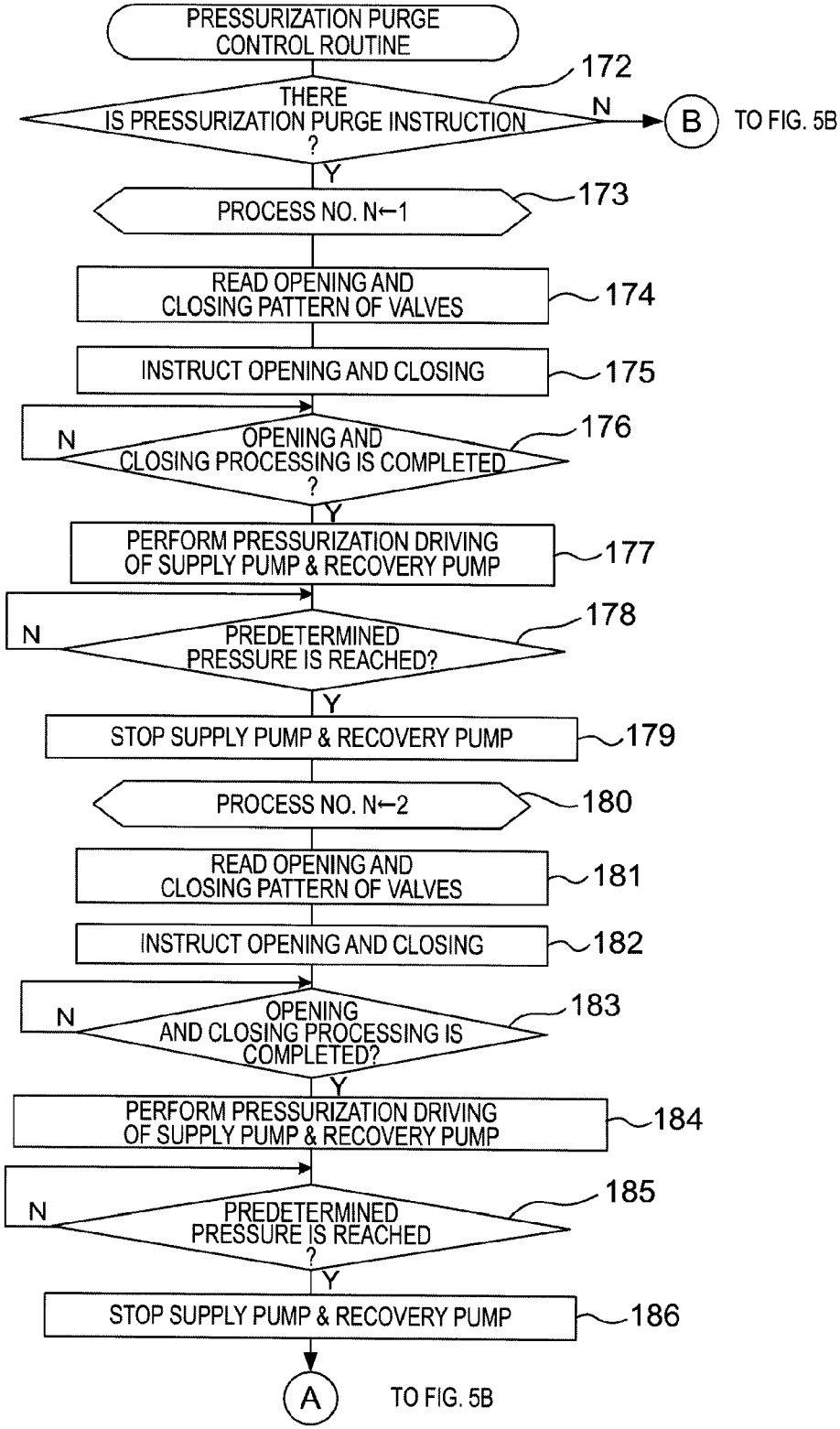
FIG. 5A is a control flowchart (first half) for executing the pressurization purge function according to the present exemplary embodiment.
Figure 5B:
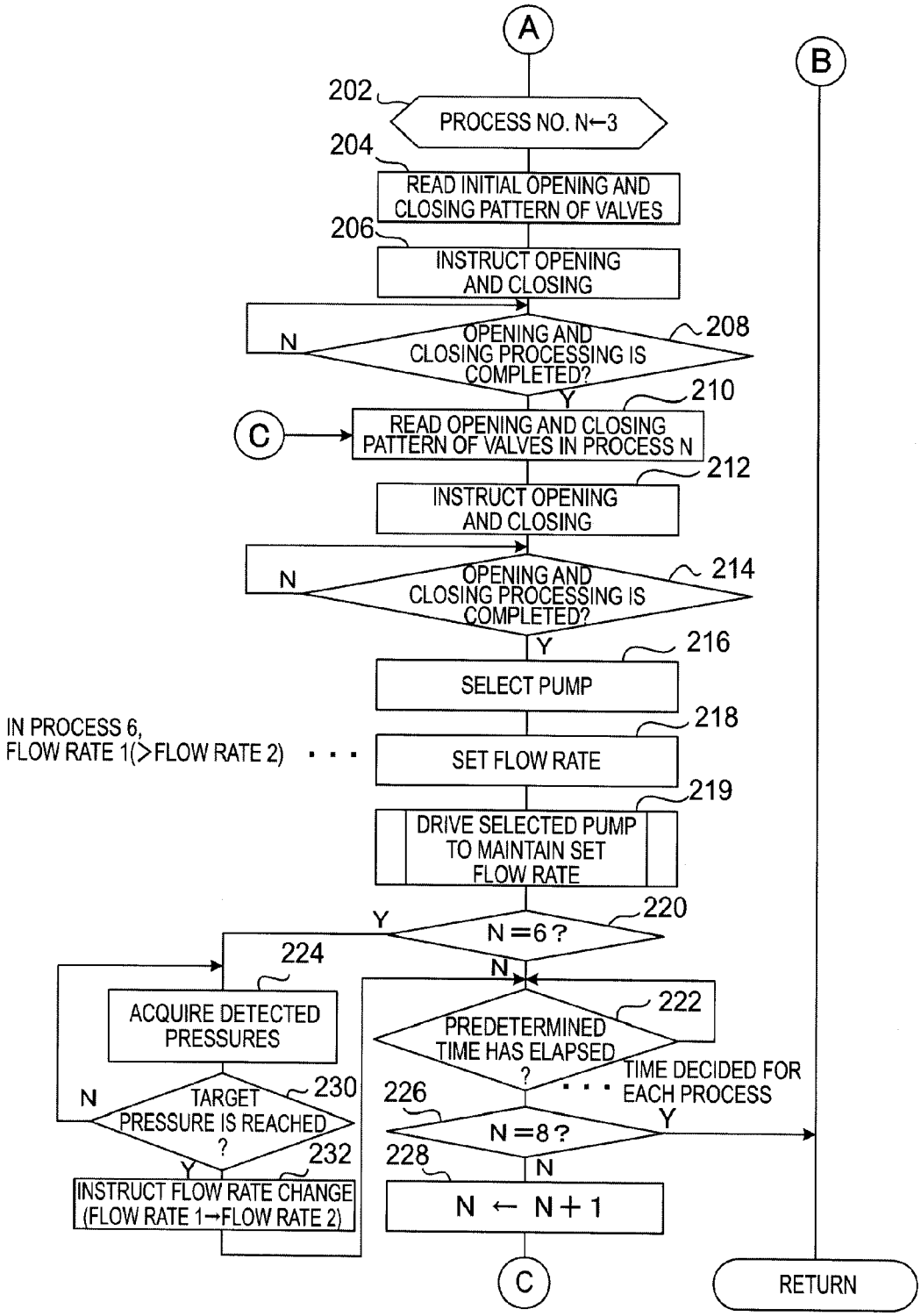
FIG. 5B is a control flowchart (latter half) for executing the pressurization purge function according to the present exemplary embodiment.

FIGS. 5A and 5B are flowcharts showing a pressurization-purge control routine.

As shown in FIG. 5A, in step 172, it is determined whether or not an instruction of the pressurization purge has been performed, and if a negative determination is made, this routine ends (refer to FIG. 5B).

If in step 172, an affirmative determination is made, the processing shifts to step 173, and a process N (an N value is "1" or "2" in FIG. 5A) is set to 1, and processing shifts to step 174.

In step 174, the opening and closing pattern of the respective valves is read from the pattern table memory 154, and subsequently, the processing goes to step 175, in which the opening and closing instructions of the respective valves are issued to the head-module circulation system control unit 126, the pressure adjustment control unit 128, and the drain control unit 130. This allows the head-module circulation system control unit 126, the pressure adjustment control unit 128, and the drain control unit 130 to open and close the respective valves based on the instructed opening and closing pattern.

In next step 176, whether or not the opening and closing of the respective valves have been completed is determined, and if an affirmative determination is made, the processing goes to step 177 to perform the pump pressurization driving adapting to the process 1, and the processing goes to step 178. In step 178, whether or not a predetermined pressure is reached is determined, and if an affirmative determination is made, the processing goes to step 179 to stop the pump driving, and further the processing goes to step 180.

In step 180, the process N (the N value in FIG. 5A is "1" or "2") is set to 2, and the processing shifts to step 181. In step 181, the opening and closing pattern of the respective valves is read from the pattern table memory 154, and subsequently, the processing goes to step 182 to issue the opening and closing instructions of the respective valves to the head-module circulation system control unit 126, the pressure adjustment control unit 128, and the drain control unit 130. This causes the head-module circulation system control unit 126, the pressure adjustment control unit 128, and the drain control unit 130 to open and close the respective valves based on the instructed opening and closing pattern.

In next step 183, whether or not the opening and closing of the respective valves have been completed is determined, and if an affirmative determination is made, the processing goes to step 184 to perform the pump pressurization driving adapting to the process 2, and then the processing goes to step 185. In step 185, whether or not the predetermined pressure has been reached is determined, and if an affirmative determination is made, the processing shifts to step 186 to stop the pump driving, and then the processing goes to step 202 in FIG. 5B.

As shown in FIG. 5B, in step 202, the value of the variable N indicating a process number is set to 3, and the processing goes to step 210.

In step S210, the opening and closing pattern of the respective valves in the process N (the N value in FIG. 5B is 3 to 8) is read from the pattern table memory 154, and subsequently, the processing goes to step 212 to issue the opening and closing instructions of the respective valves to the head-module circulation system control unit 126, the pressure adjustment control unit 128, and the drain control unit 130. This causes the head-module circulation system control unit 126, the pressure adjustment control unit 128, and the drain control unit 130 to open and close the respective valves based on the instructed opening and closing pattern (in FIG. 5B, any one of the opening and closing patterns in the processes 3 to 8).

In the next step 214, whether or not the opening and closing of the respective valves have been completed is determined, and if an affirmative determination is made, the processing goes to step 216 to select the pump(s) adapting to the process N (the supply-side pump 54 and/or the recovery-side pump 80), and the processing goes to step 218. In step 218, the flow rate is set, and in step 219, the control to drive the selected pump based on the set flow rate is started, and the processing goes to step 220.

In step 220, whether or not the current value of the variable N is 6, or that is, whether or not the process 6 is started is determined.

If in step 220, a negative determination is made, the process is determined to be any one of processes 3 to 5, 7, and 8, and the processing goes to step 222. On the other hand, if in step 220, an affirmative determination is determined, the process 6 is determined, and the processing goes to step 224.

Figure 9:
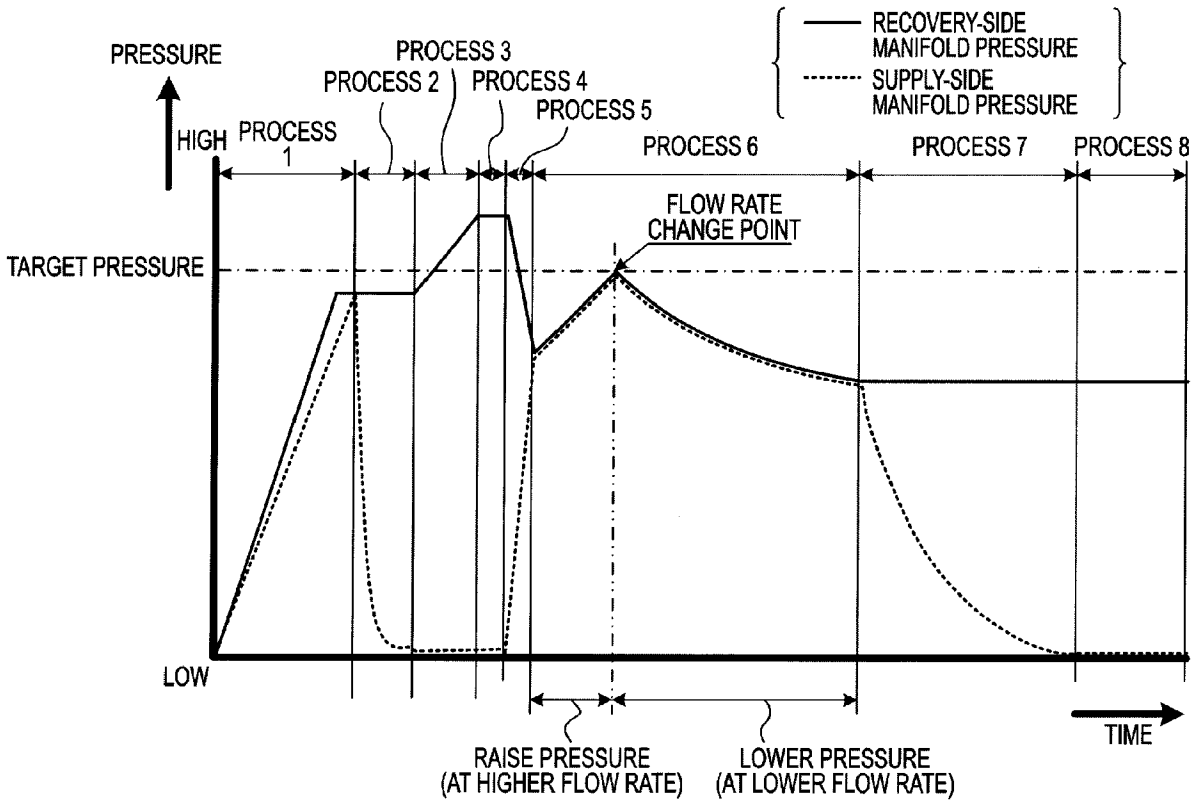
FIG. 9 is a pressure transition characteristic diagram in the respective processes during the pressurization purge control according to the present exemplary embodiment.

In the present exemplary embodiment, in the others than the process 6 (processes 3 to 5, 7, 8), the driving of the pump selected by the timer management is controlled, and the flow rate is controlled to be within a range. On the other hand, in the process 6, in addition to the timer driving, the selected pump is driven at the original flow rate (flow rate 1), and when the predetermined target pressure is reached, the flow rate is changed from the flow rate 1 to the flow rate 2, (flow rate 1>flow rate 2), by which transition of the pressure pattern shown in FIG. 9 is realized.

That is, if a negative determination is made in step 220 and the processing goes to step 222, it is determined in step 222 whether or not predetermined time of the process N has elapsed while maintaining the pump driving control set in step 216 and in step 218.

If in this step 222, an affirmative determination is made, the processing goes to step 226 to determine whether or not the current process is the process 8, and if a negative determination is made, the processing goes to step 228 to increment the variable N (N←N+1), and the processing returns to step 210 to repeat the foregoing.

Moreover, if in step 226, an affirmative determination is made, it is determined that all the processes have ended, and this routine ends.

Next, if in step 220, an affirmative determination is made and the processing shifts to step 224, in step 224, the detected pressure values from the supply-side pressure sensor 40 and the recovery-side pressure sensor 42 are acquired, and the processing shifts to step 230.

In step 230, whether or not the acquired detected pressure values have reached the preset target pressure value is determined.

If in this step 230, a negative determination is made, the flow rate set in step 218 is maintained (the flow rate 1), and the processing returns to step 224 to repeat the foregoing.

Moreover, if in step 230, an affirmative determination is made, it is determined that the acquired detected pressure values have reached the target pressure, and the processing goes to step 232 to change from the flow rate 1 set in step 210 to flow rate 2 (flow rate 1>flow rate 2), and further the processing goes to step 222. Hereinafter, in the latter half of the process 6 (after the target pressure has been reached), the driving of the pump is controlled by the timer control.

FIG. 9 is a pressure transition characteristic diagram under the control in accordance with the above-described flowchart in FIGS. 5A and 5B. Hereinafter, details of states on the process basis will be described with reference to FIGS. 6A to 6E and FIGS. 7A to 7C.

[Process 1]

Figure 6A:
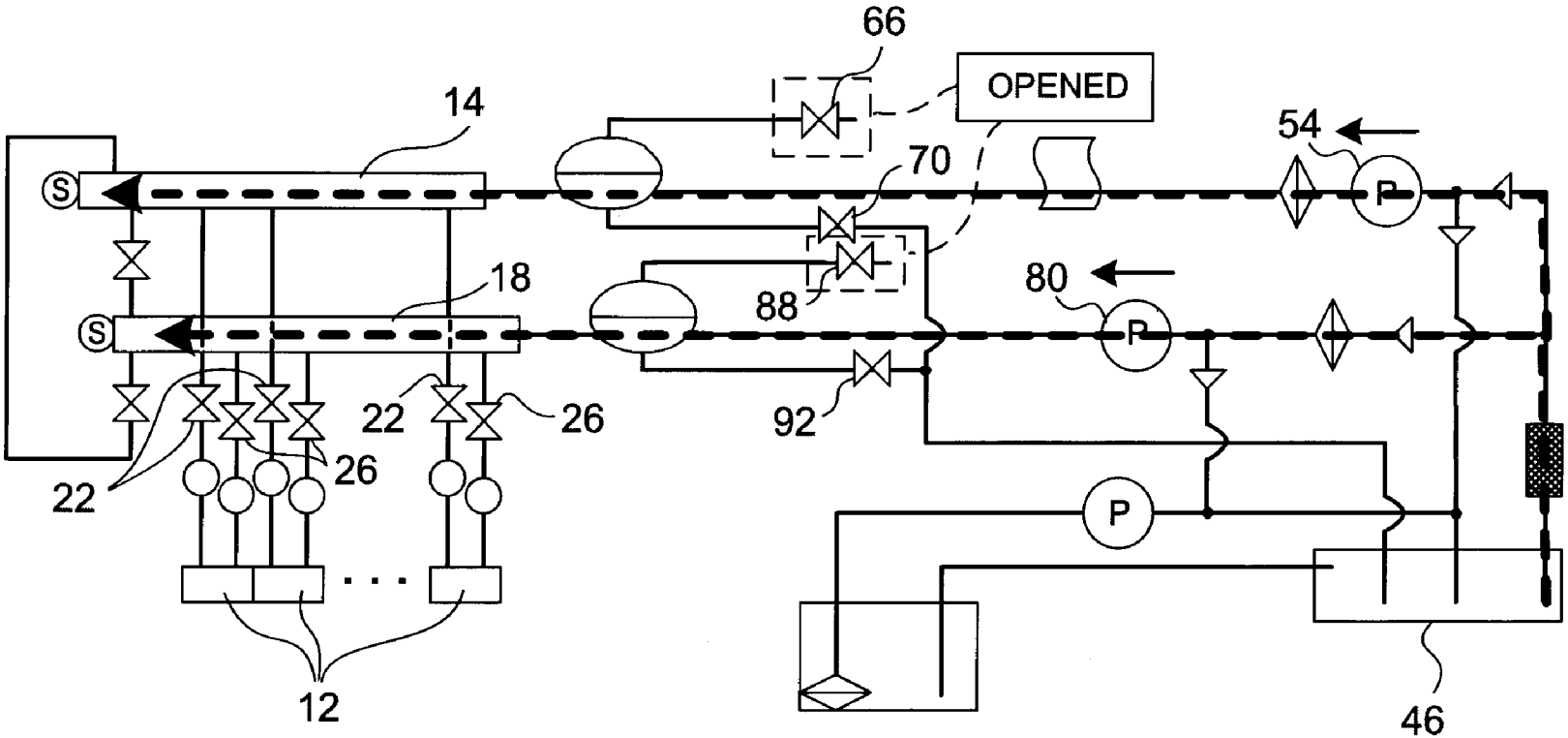
FIGS. 6A to 6E are diagrams of flow paths ensured by valve opening and closing during the pressurization purge control according to the present exemplary embodiment, FIG. 6A showing the flow path in a process 1, FIG. 6B showing the flow path in a process 2, FIG. 6C showing the flow path in a process 3, FIG. 6D showing the flow path in a process 4, and FIG. 6E showing the flow path in a process 5.

As shown in FIG. 6A, from the state of the initial opening and closing pattern, the supply-side air valve 66 and the recovery-side air valve 88 under the control of the pressure adjustment control unit 128 are all opened before the pressurization purge execution.

Pressurization driving of the supply-side pump 54 and the recovery-side pump 80 is performed.

When the pressure of the supply-side manifold 14 and the pressure of the recovery-side manifold 18 reach the predetermined value, respectively, the supply-side pump 54 and the recovery-side pump 80 are stopped.

[Process 2]

Figure 6B:
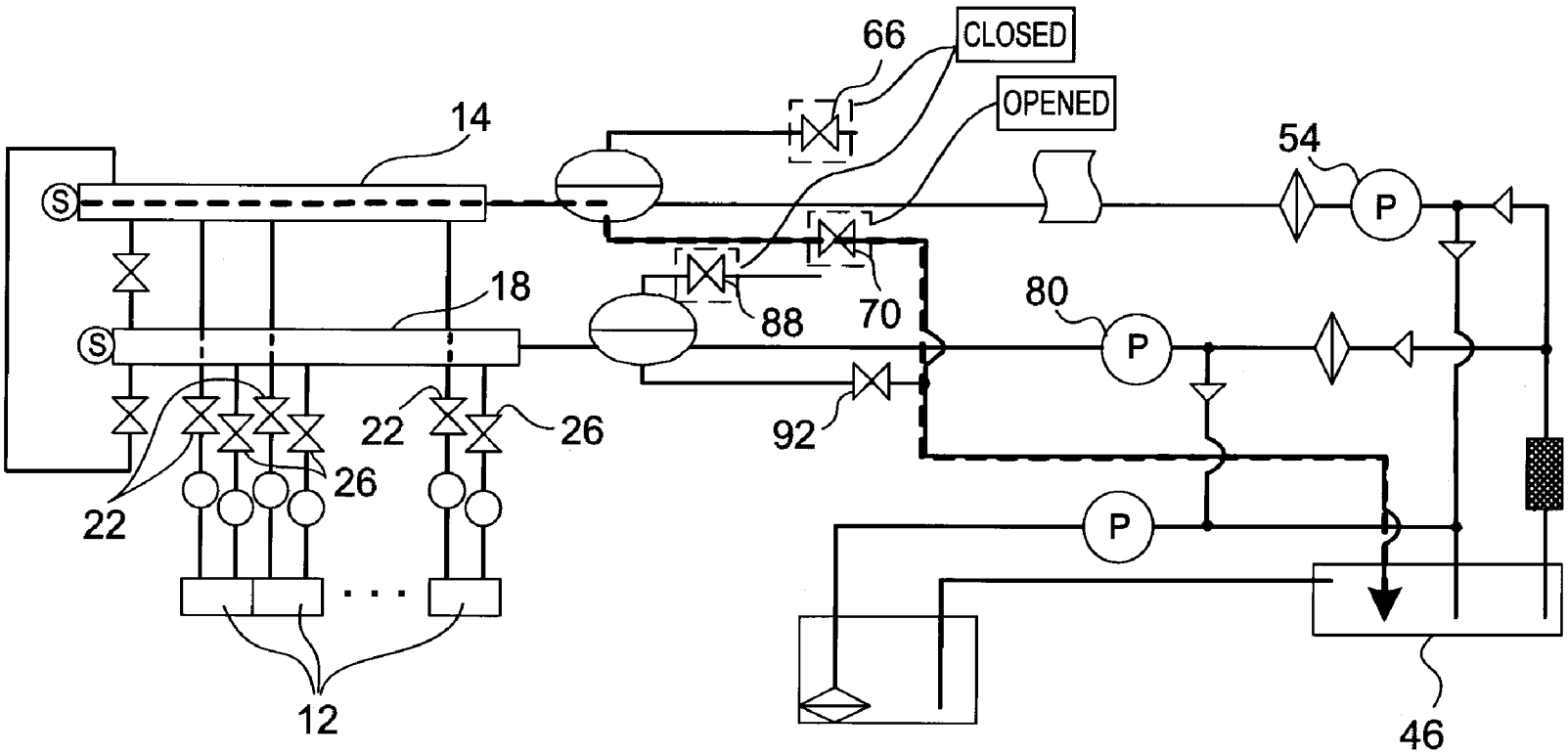

As shown in FIG. 6B, from the state of the process 1, the supply-side air valve 66 and the recovery-side air valve 88 are closed, and the supply-side drain valve 70 is opened to release the pressure of the supply-side manifold 14.

[Process 3]

Figure 6C:
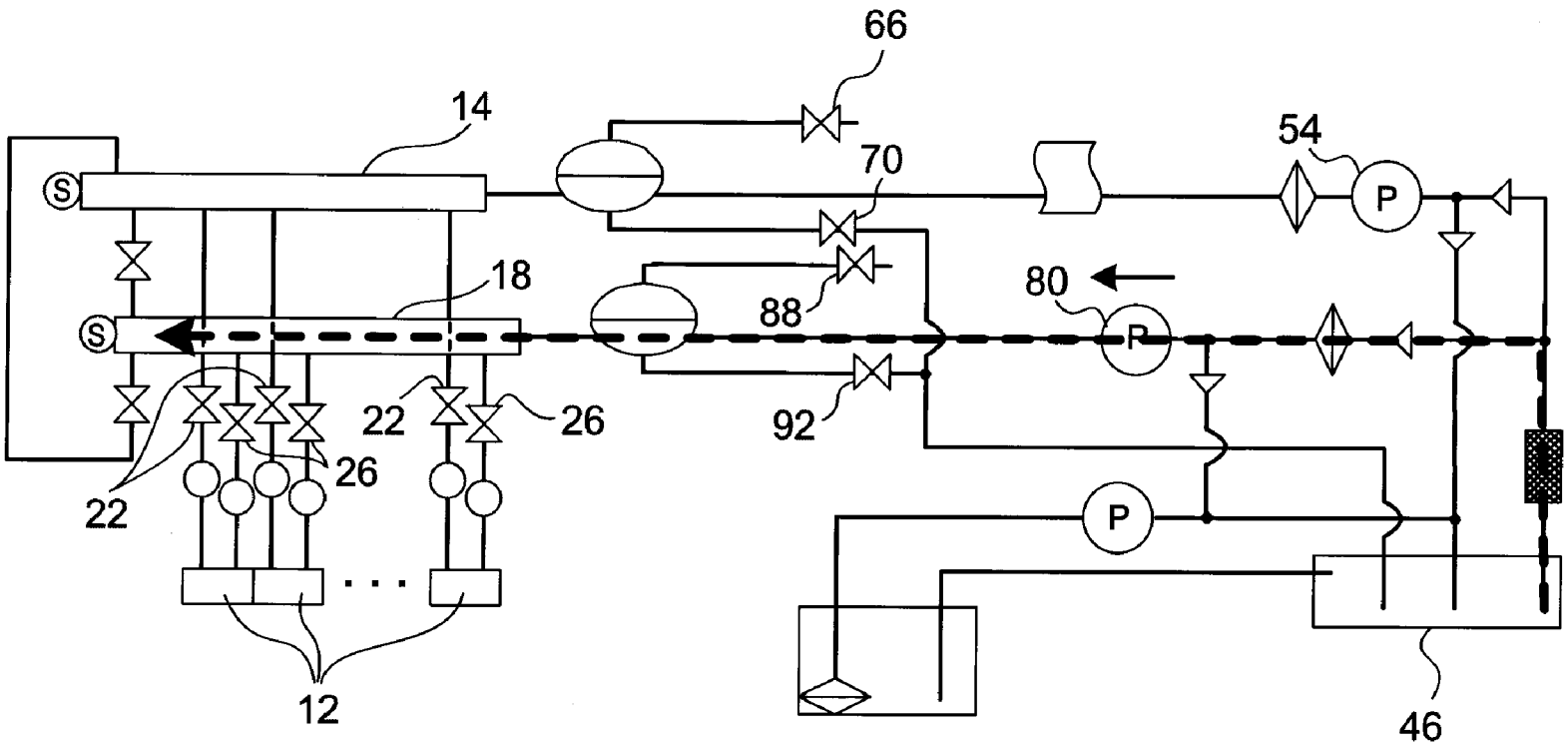

As shown in FIG. 6C, from the state of the process 2, the supply-side drain valve 70 is closed.

Since in a state where the supply-side valve 22, the recovery-side valve 26, the first communicating valve 36, the second communicating valve 38, and the recovery-side drain valve 92 are closed, the recovery-side pump 80 starts to be driven at the predetermined flow rate (in the present exemplary embodiment, as one example, 4 mL/sec), the pressure inside the recovery-side manifold 18 is rapidly increased. On the other hand, the pressure of the supply-side manifold 14 does not change (e.g., a normal pressure (one barometric pressure)).

When the pressure inside the recovery-side manifold 18 exceeds a predetermined value (in the present exemplary embodiment, as one example, 40 kPa), the recovery-side pump 80 is stopped.

[Process 4]

Figure 6D:
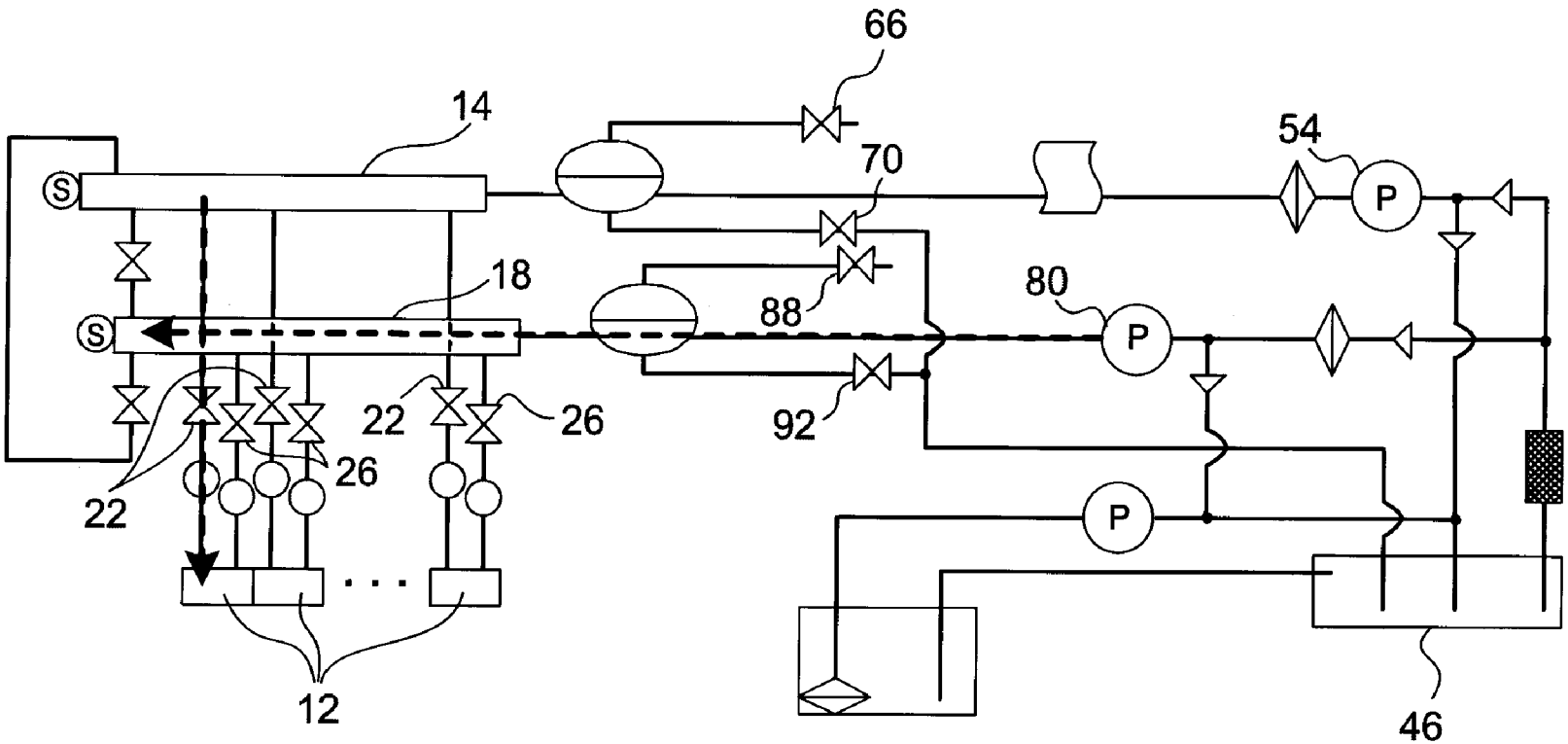

As shown in FIG. 6D, from the state of the process 3, the supply-side valve 22 is opened in the pressurized state. There is no communication with the recovery-side manifold 18, and in the recovery-side manifold 18, the pressure value in the process 3 is maintained.

[Process 5]

Figure 6E:
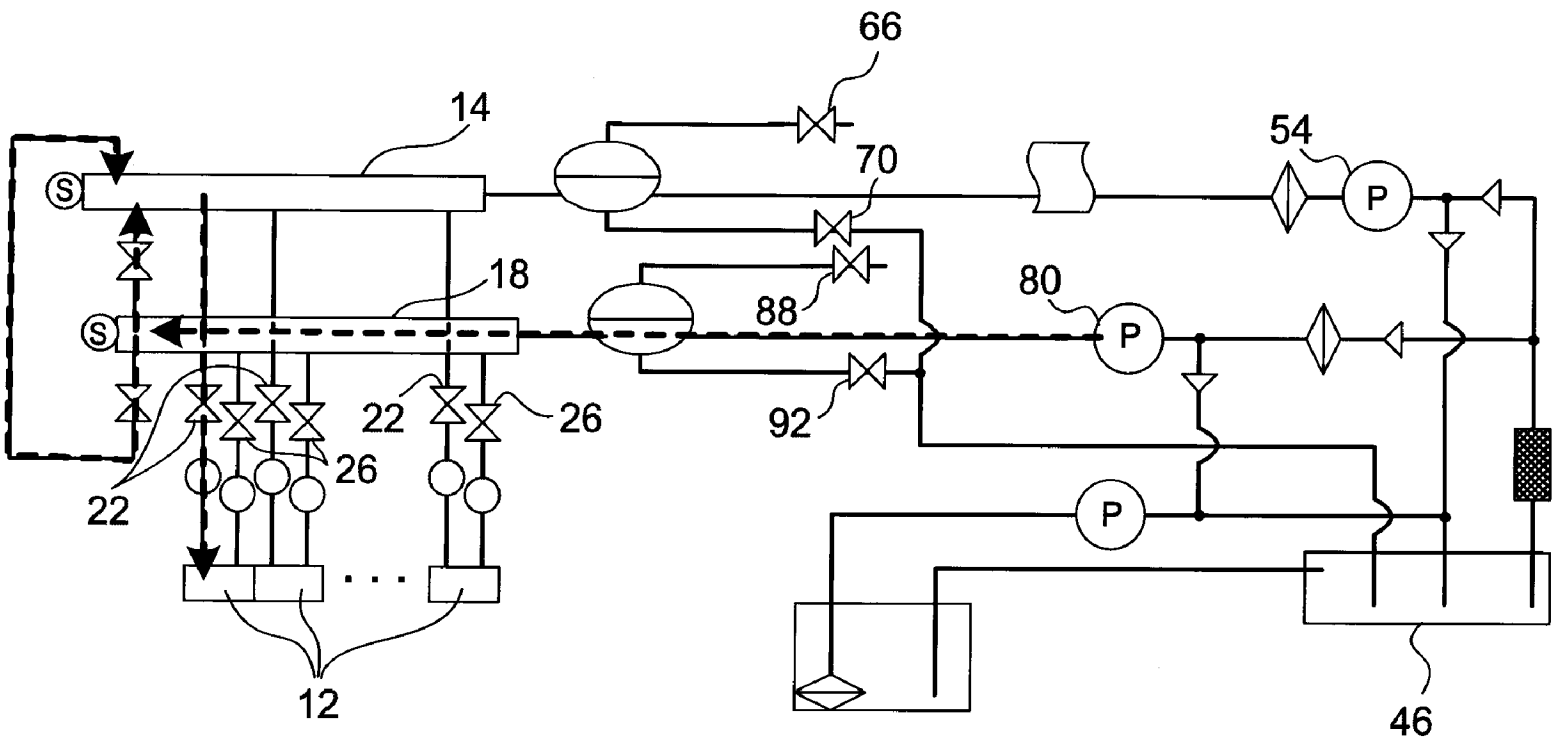

As shown in FIG. 6E, from the state of the process 4, the first communicating valve 36 and the second communicating valve 38 are opened, so that part of the ink filled in the recovery-side manifold 18 flows into the supply-side manifold 14, and as a result, the internal pressures of the supply-side manifold 14 and the recovery-side manifold 18 become the same within a predetermined an acceptable error range. The processes 1 to 5 are preliminary stages of the pressurization purge, and in this state, the processing goes to the process 6.

[Process 6]

Figure 7A:
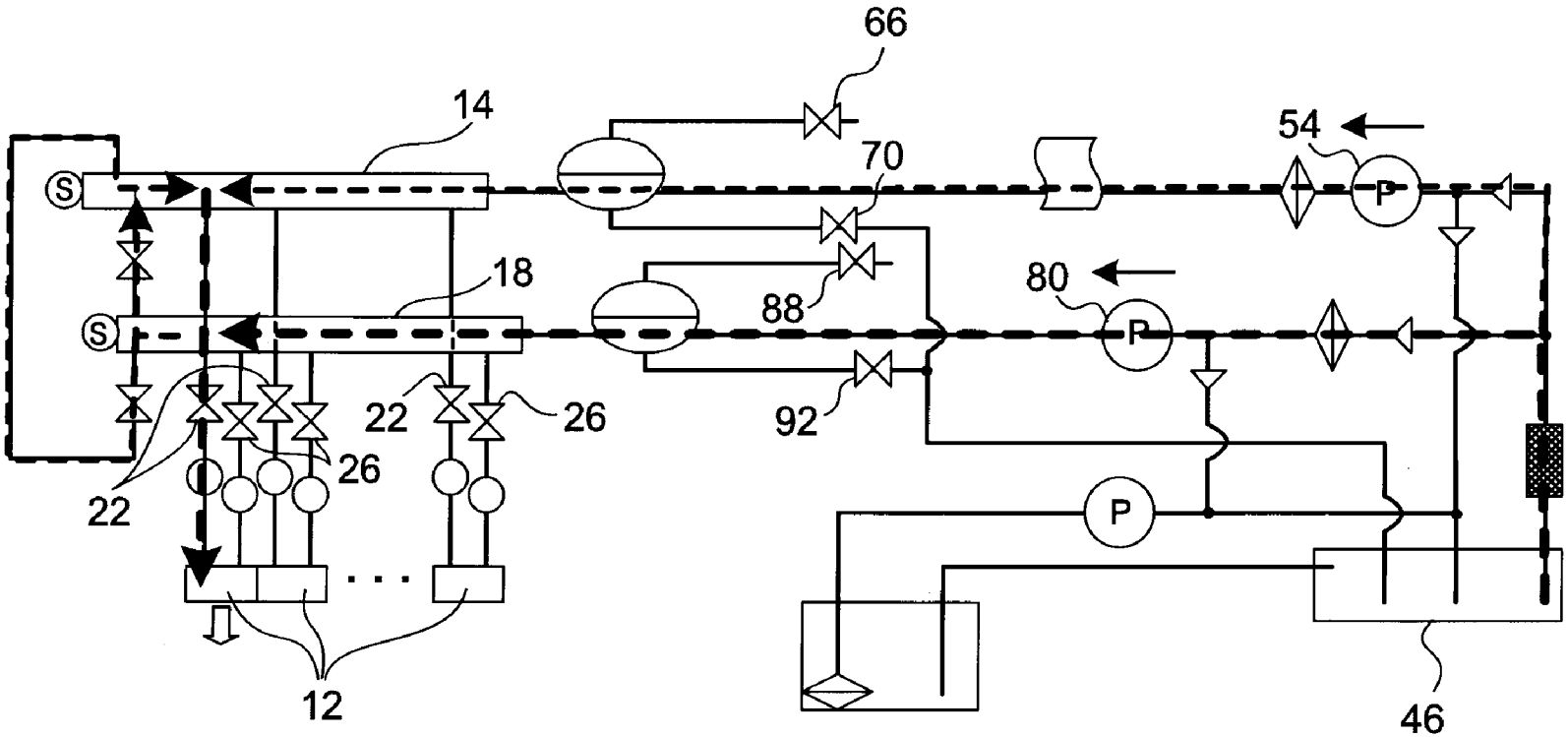
FIGS. 7A to 7C are diagrams of flow paths ensured by the valve opening and closing during the pressurization purge control according to the present exemplary embodiment, FIG. 7A showing the flow path in a process 6, FIG. 7B showing the flow path in a process 7, and FIG. 7C showing the flow path in a process 8.

As shown in FIG. 7A, the driving of the supply-side pump 54 is started while maintaining the valve state in the process 5 and continuing the driving of the recovery-side pump 80. The flow rate at this time is the flow rate 1 (in the present exemplary embodiment, as one example, 4 mL/sec), which results in a pressure change rate at which the internal pressure of each of the supply-side manifold 14 and the recovery-side manifold 18 is raised (in the present exemplary embodiment, as one example, 30 to 50 kPa/sec). This raised pressure passes through the opened supply-side valve 22 of the head module 12 to increase a pressure in the reservoir chamber of the head-module 12. As a result, the air bubbles adhering to the inner wall of the reservoir chamber come off and are put into a state where they float inside the ink. In this state, the air bubbles are easily ejected from the nozzles.

This pressure rising is continued up to the predetermined target pressure value (in the present exemplary embodiment, as one example, 30 kPa), and once the target pressure value is reached, the flow rate is changed to the flow rate 2 (in the preset exemplary embodiment, as one example, 0.1 mL/sec) lower than the flow rate 1 (in the present exemplary embodiment, as one example, 4 mL/sec) by the driving control of the supply-side pump 54 and the recovery-side pump 80. As a result, the internal pressure of each of the supply-side manifold 14 and the recovery-side manifold 18 has a decreasing pressure change rate, which is lower than the change rate during pressure rising.

In other words, in the process 6, the control is performed such that the pressures are raised up to the target pressure at the relatively rapid pressure change rate, and then, are decreased at the relatively moderate pressure change rate (in the present exemplary embodiment, as one example, −2 to −6 kPa/sec).

Since the above-described pressure control gradually decreases the pressures, the air bubbles floating inside the reservoir chamber of the head module 12 are ejected from the nozzles, while avoiding a phenomenon that the air flows back from the nozzles of the head module 12.

[Process 7]

Figure 7B:
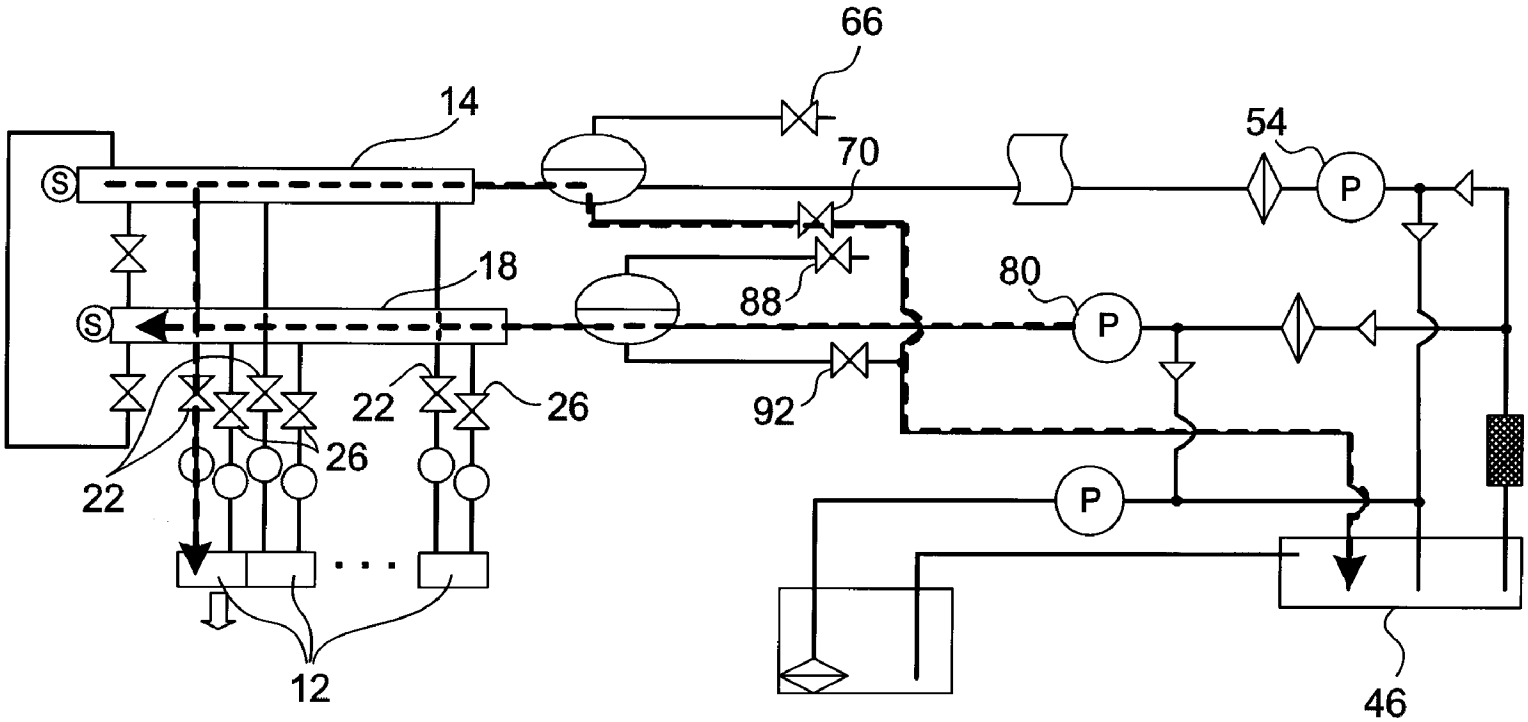

As shown in FIG. 7B, from the state of the process 6, the driving of the pumps is stopped, the first communicating valve 36, and the second communicating valve 38 are closed, and the supply-side drain valve 70 is opened, which naturally decreases the pressures of the supply-side manifold 14 and the reservoir chamber inside the head module 12 to the normal pressure (e.g., one barometric pressure). On the other hand, in the recovery-side manifold 18, the pressure at the end of the process 6 is maintained as it is.

[Process 8]

Figure 7C:
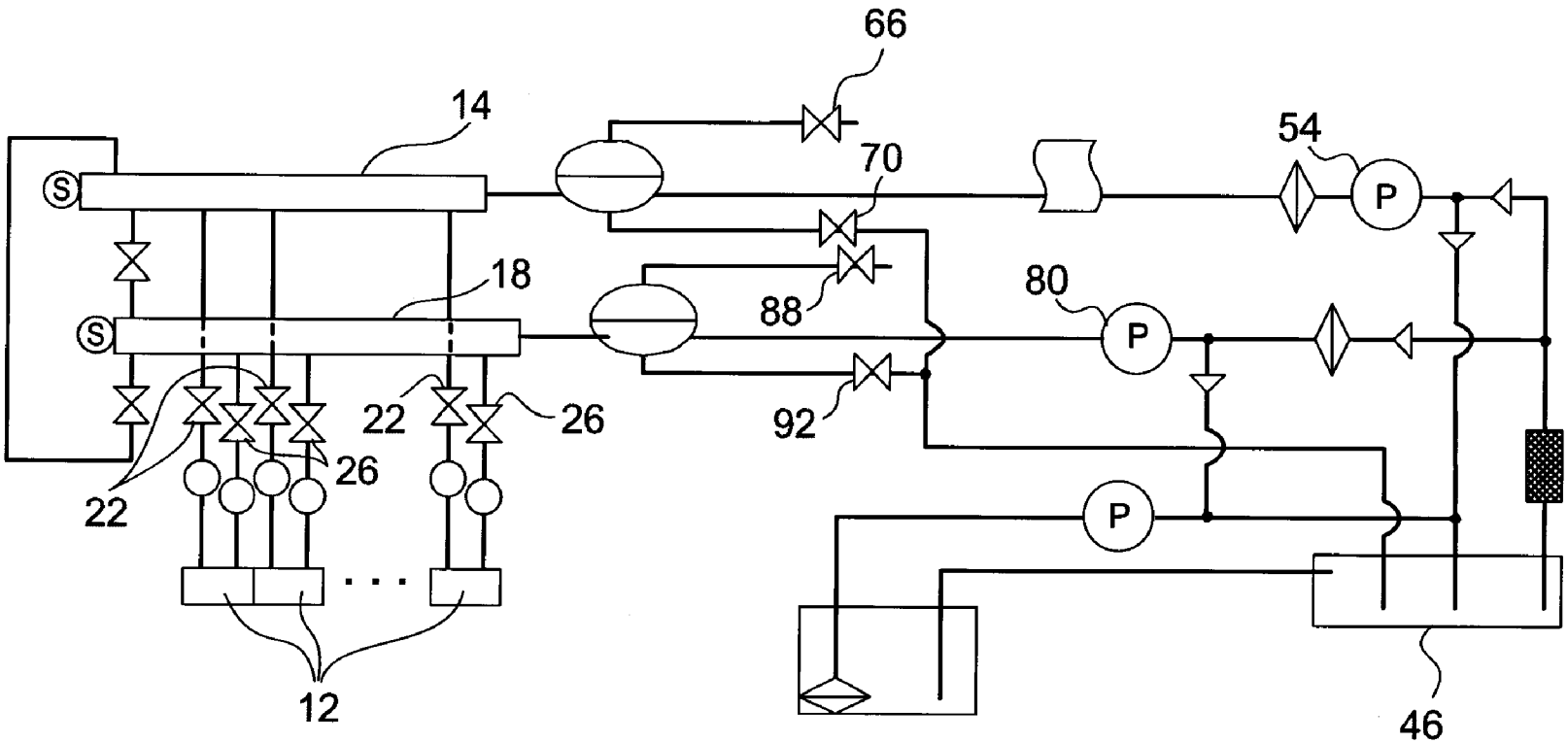

As shown in FIG. 7C, the supply-side valve 22 is closed, and the supply-side drain valve 70 opened in the process 7 is closed to end the pressurization purge control. The pressures are maintained at the end of the process 7.

While in the foregoing, only one of the head modules 12 is described as a subject, the above-described processes are sequentially repeated, by which an arbitrary number of head modules (e.g., when there are 17 head modules 12, 1 to 17) are all subjected to the pressurization purge. Moreover, while the flow rate 1 and the flow rate 2 are set with the single head module 12 as a subject, in the case where the two or more head modules 12 are simultaneously subjected to the pressurization purge, the flow rate 1 and the flow rate 2 set in the single head module 12 only need to be multiplied by the number of head modules (the low rate 1←the flow rate 1×the number of head modules, the flow rate 2←the flow rate 2×the number of head modules).

Moreover, in the above-described exemplary embodiment, in the process 6, the flow rate 1 and the flow rate 2 (flow rate 1>flow rate 2) are set, so that the pressures are raised at the relatively rapid pressure change rate, and after the target pressure is reached, the pressures are lowered at the relatively moderate pressure change rate, by which the air bubbles adhering to the inner wall of the reservoir chamber of the head module 12 are caused to come off and are floated during the pressure rising, and then the air bubbles are ejected from the nozzles of the head module 12 during the pressure lowering. However, with the process 6, pressure transition patterns shown in Modifications 1, 2 described below may be employed. This pressure transition may be all realized by the flow rate control of the supply-side pump 54 and the recovery-side pump 80. Moreover, since the number of processes in Modifications 1, 2 are the same as the number of processes in the above-described exemplary embodiment, and the control in the processes 1 to 5, 7, and 8 is the same, the pressure transition of the process 6 will be described, and other descriptions will be omitted.

(Modification 1)

Figure 10:
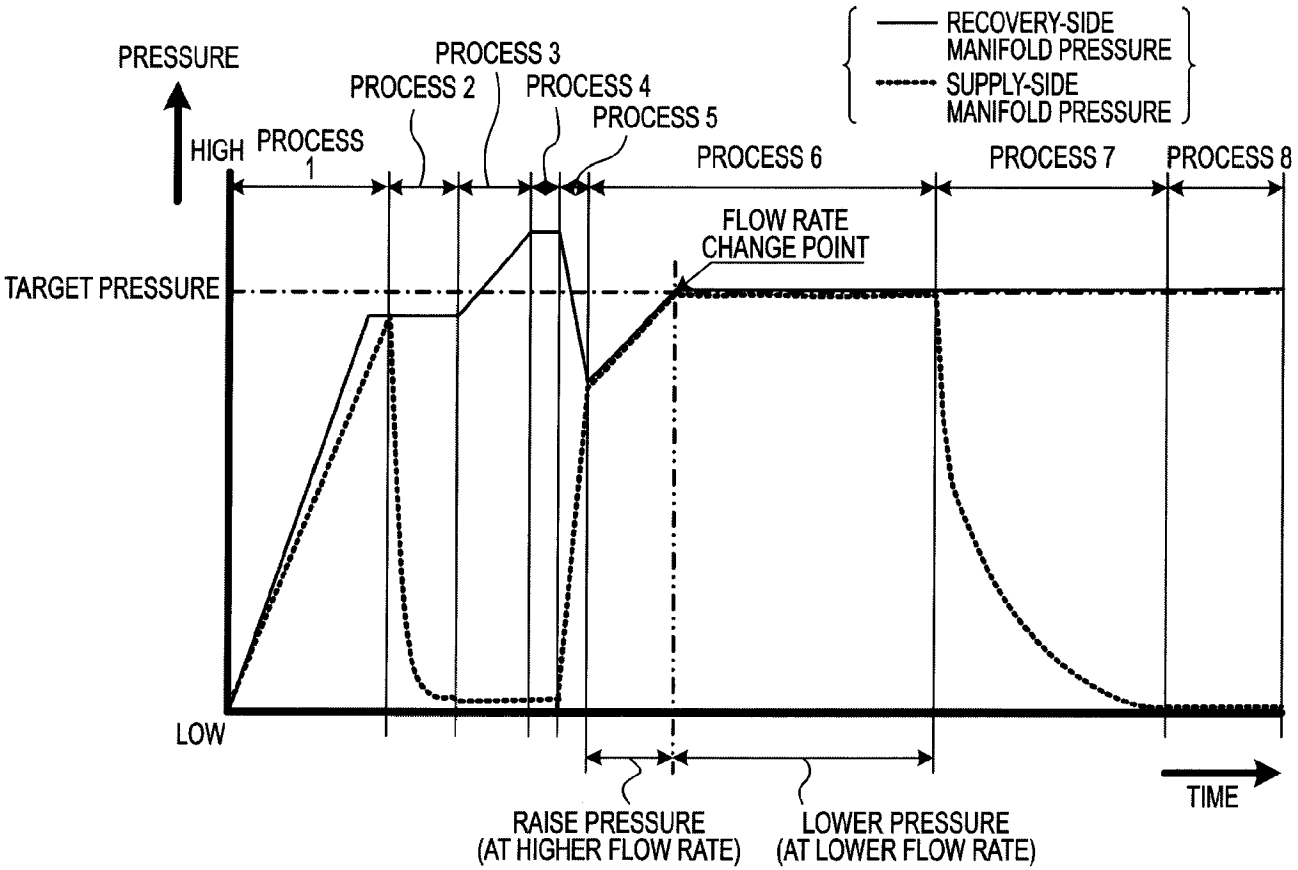
FIG. 10 is a pressure transition characteristic diagram in the respective processes during the pressurization purge control according to Modification 1 of the present exemplary embodiment.

As shown in FIG. 10, in the process 6 of Modification 1, after the pressure rising up to the target pressure, the target pressure is maintained by the flow rate control (setting of the flow rate 2). Maintaining the target pressure prevents occurrence of trouble that ejection ability of the air bubbles is gradually reduced, because the target pressure is maintained even when the ink flows out together with the air bubbles from the reservoir chamber inside the head module 12 through the nozzles.

(Modification 2)

Figure 11:
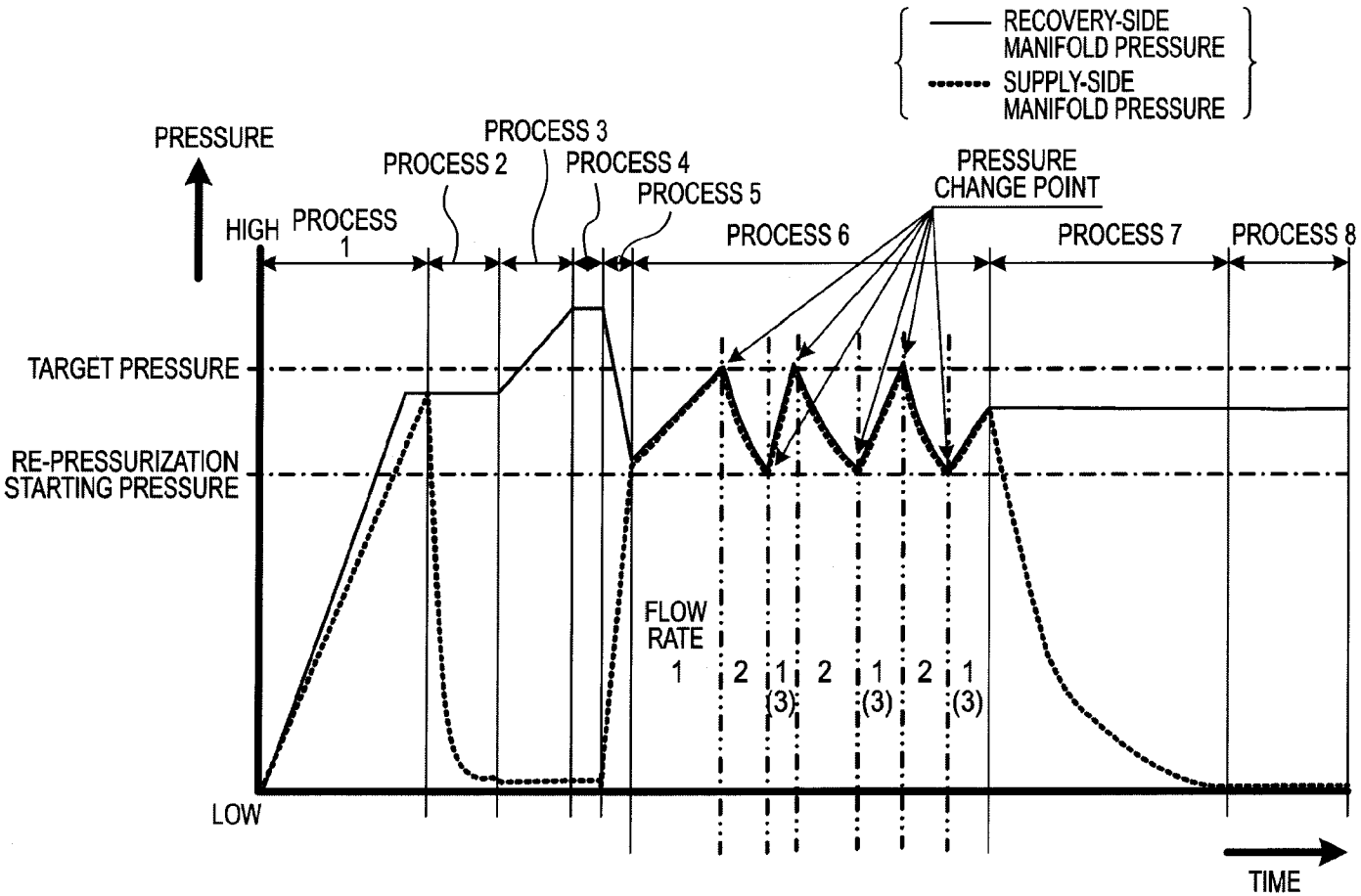
FIG. 11 is a pressure transition characteristic diagram in the respective processes during the pressurization purge control according to Modification 2 of the present exemplary embodiment.

As shown in FIG. 11, in Modification 2, in addition to the control of the flow rate 1 and the flow rate 2, a flow rate 3 (≈flow rate 1>flow rate 2) is set to change the pressures in a jagged manner. The pressures are changed little by little, which makes the movement of the air bubbles in the reservoir chamber inside the head modules 12 active, thereby promoting the ejection.

The flow rate 3 is the same as the flow rate 1 within a predetermined acceptable error range, and in short, the relatively rapid pressure rising and the moderate pressure lowering only need to be realized. A period when the target pressure is maintained may be provided between the pressure rising and the pressuring lowering.

(Modification 3)

As shown in FIGS. 12A to 12F, 13, and 14, in Modification 3, the pressurization purge control in 6 processes is performed. FIGS. 12A to 12F show the opening and closing patterns of the respective valves in the respective processes.

Figure 12A:
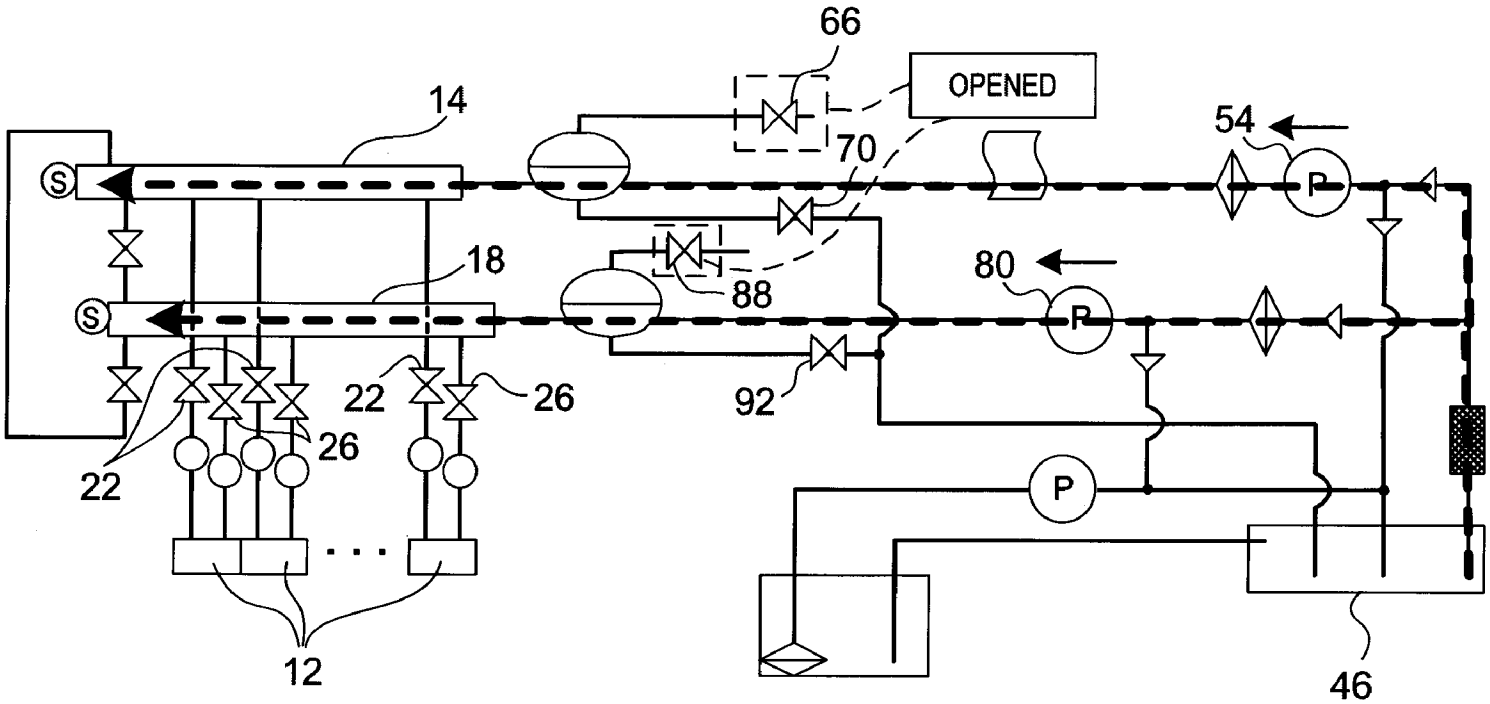
FIGS. 12A to 12F are diagrams of flow paths ensured by the valve opening and closing during the pressurization purge control according to Modification 3 of the present exemplary embodiment, FIG. 12A showing the flow path in a process 1, FIG. 12B showing the flow path in a process 2, FIG. 12C showing the flow path in a process 3, FIG. 12D showing the flow path in a process 4, FIG. 12E showing the flow path in a process 5, and FIG. 12F showing the flow path in a process 6.

In the process 1, as shown in FIG. 12A, from the state of the initial opening and closing pattern, the supply-side air valve 66 and the recovery-side air valve 88 under the control of the pressure adjustment control unit 128 are all opened before the pressurization purge execution.

Pressurization driving of the supply-side pump 54 and the recovery-side pump 80 is performed.

When the pressure of the supply-side manifold 14 and the pressure of the recovery-side manifold 18 reach a predetermined value, respectively, the supply-side pump 54 and the recovery-side pump 80 are stopped.

Figure 12B:
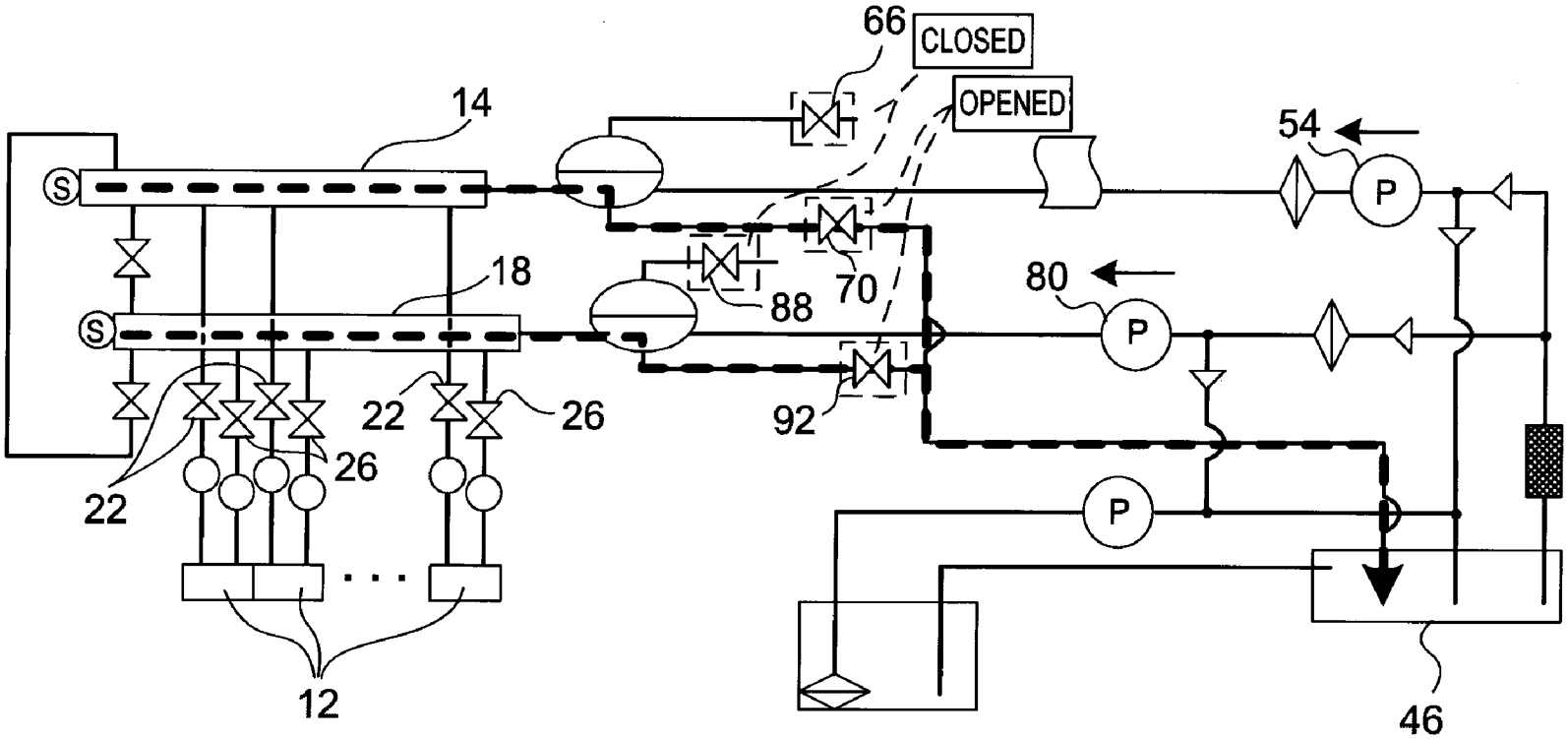

In the process 2, as shown in FIG. 12B, from the state of the process 1, the supply-side air valve 66 and the recovery-side air valve 88 are closed, and the supply-side drain valve 70 and the recovery-side drain valve 92 are opened to release the pressures of the supply side manifold 14 and the recovery-side manifold 18.

Figure 12C:
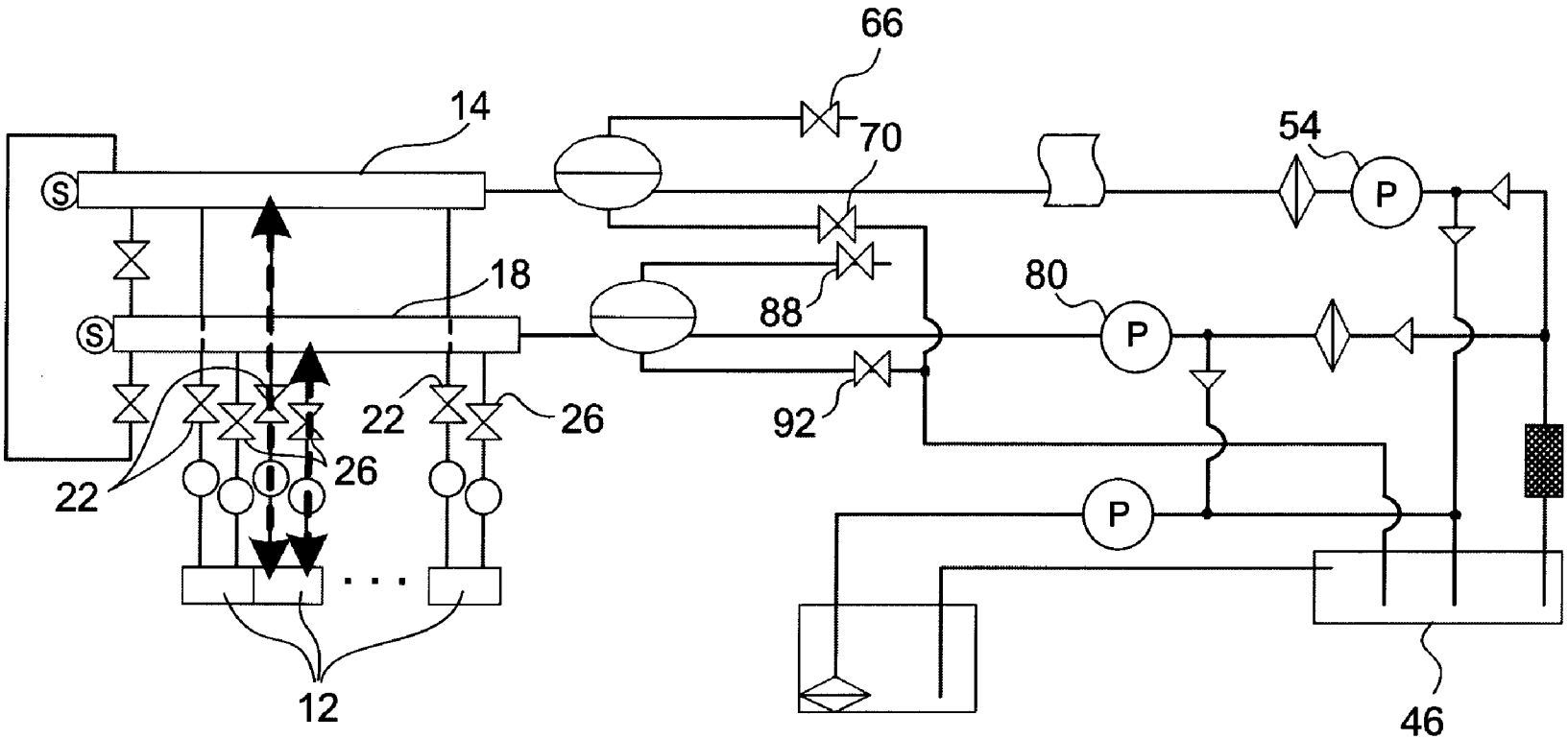

As shown in FIG. 12C, in the process 3, the supply-side valve 22 and the recovery-side valve 26 are opened. The process 3 corresponds to a line between the process 2 and the process 4, although not shown in FIG. 14.

Figure 12D:
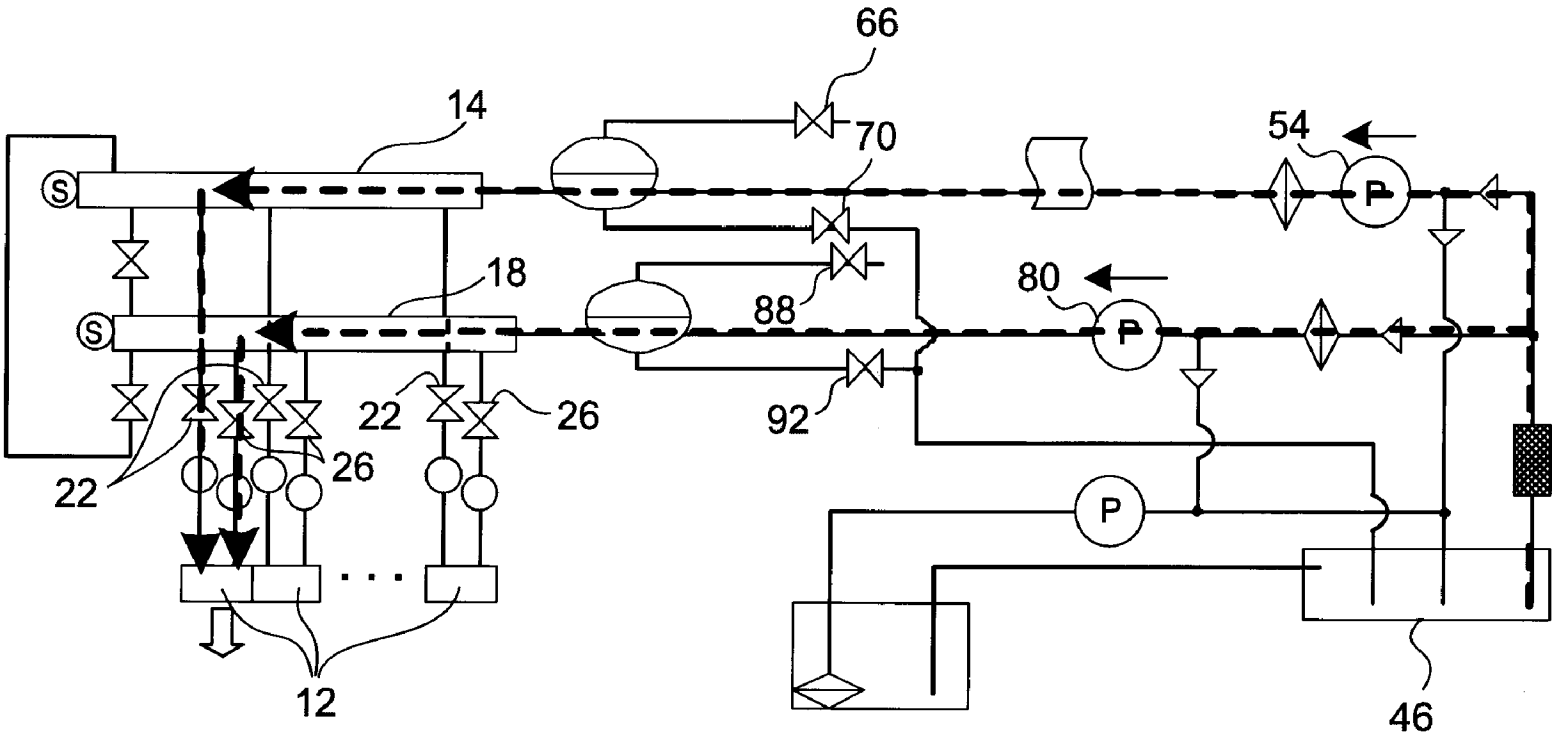

Subsequently, as shown in FIG. 12D, in the process 4, the supply-side pump 54 and the recovery-side pump 80 are driven at the flow rate 1 equivalent to the flow rate 1 in the above-described exemplary embodiment while maintaining the opening and closing state of the respective valves in the process 3. As a result, the pressure of each of the supply-side manifold 14, the recovery-side manifold 18 and the reservoir chamber of the head module 12 is raised at the relatively rapid pressure change rate (in the present exemplary embodiment, as one example, 30 to 50 kPa/sec).

Thereafter, at a point when the target pressure is reached, the flow rate by the supply side-pump 54 and the recovery-side pump 80 is changed from the flow rate 1 (in the present exemplary embodiment, as one example 4 mL/sec) to the flow rate 2 (in the present exemplary embodiment, as one example, 0.1 mL/sec) (<flow rate 1), by which the pressure of each of the supply-side manifold 14, the recovery-side manifold 18 and the reservoir chamber of the head module 12 is lowered at the relatively moderate pressure change rate (in the present exemplary embodiment, as one example, −2 to −6 kPa/sec).

The process 4 of Modification 3 has a function similar to that of the process 6 described in the present exemplary embodiment.

Figure 12E:
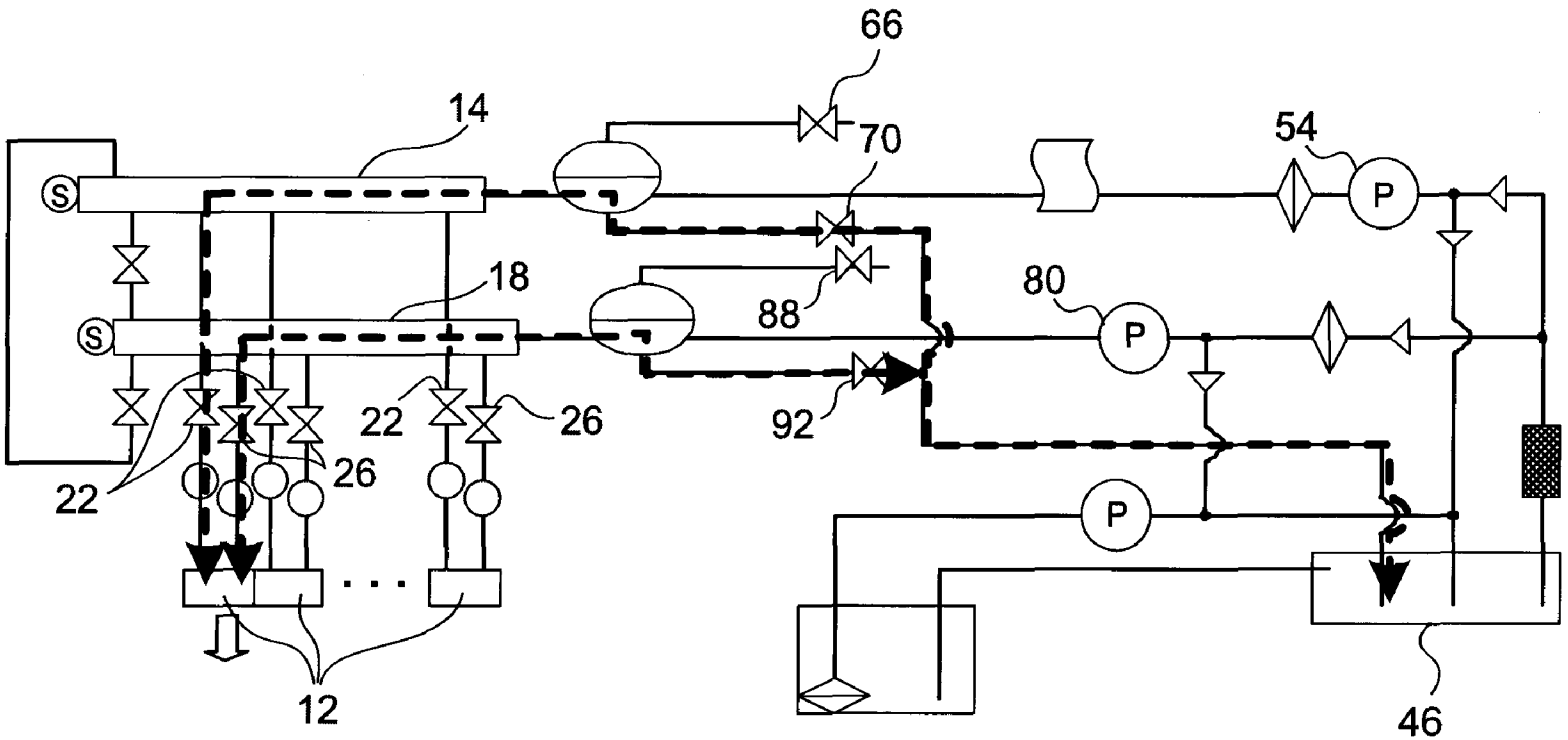
Figure 12F:
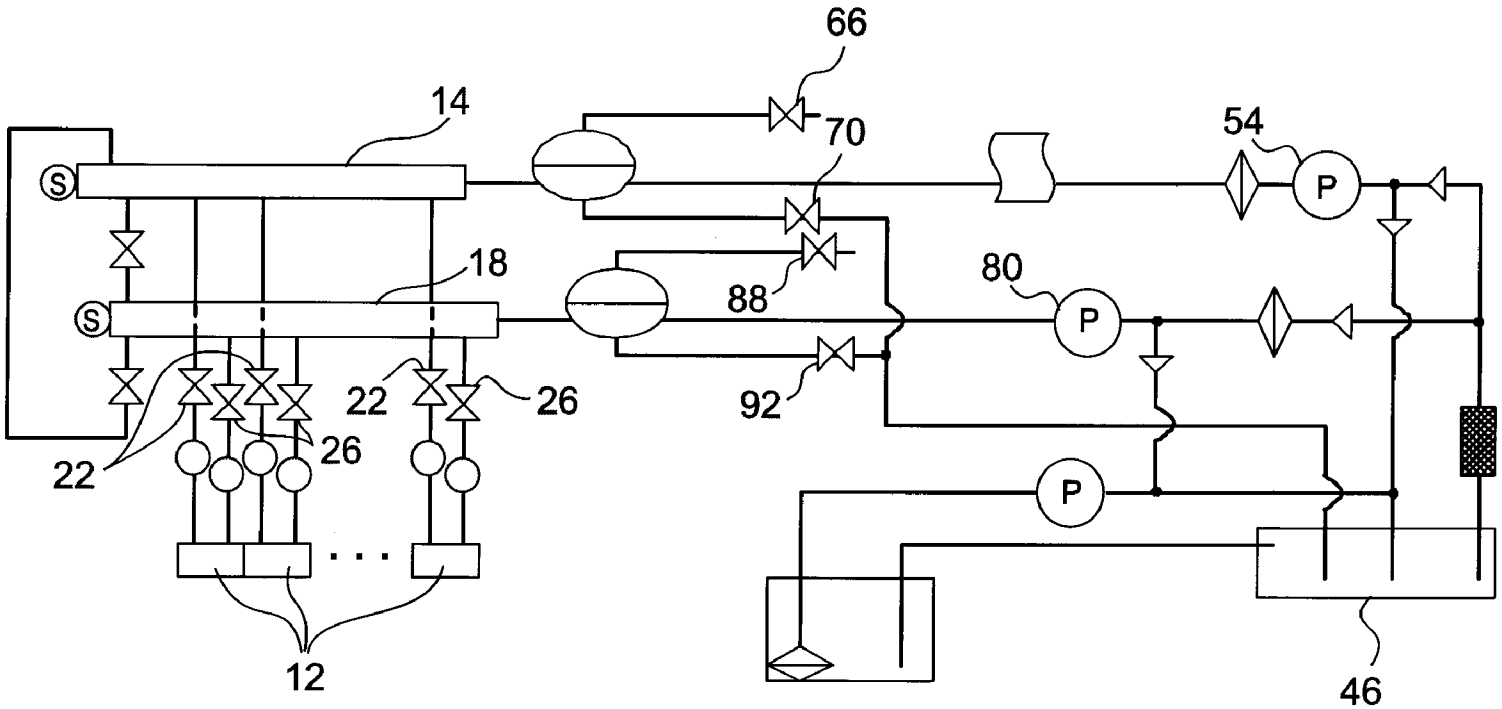
Figure 14:
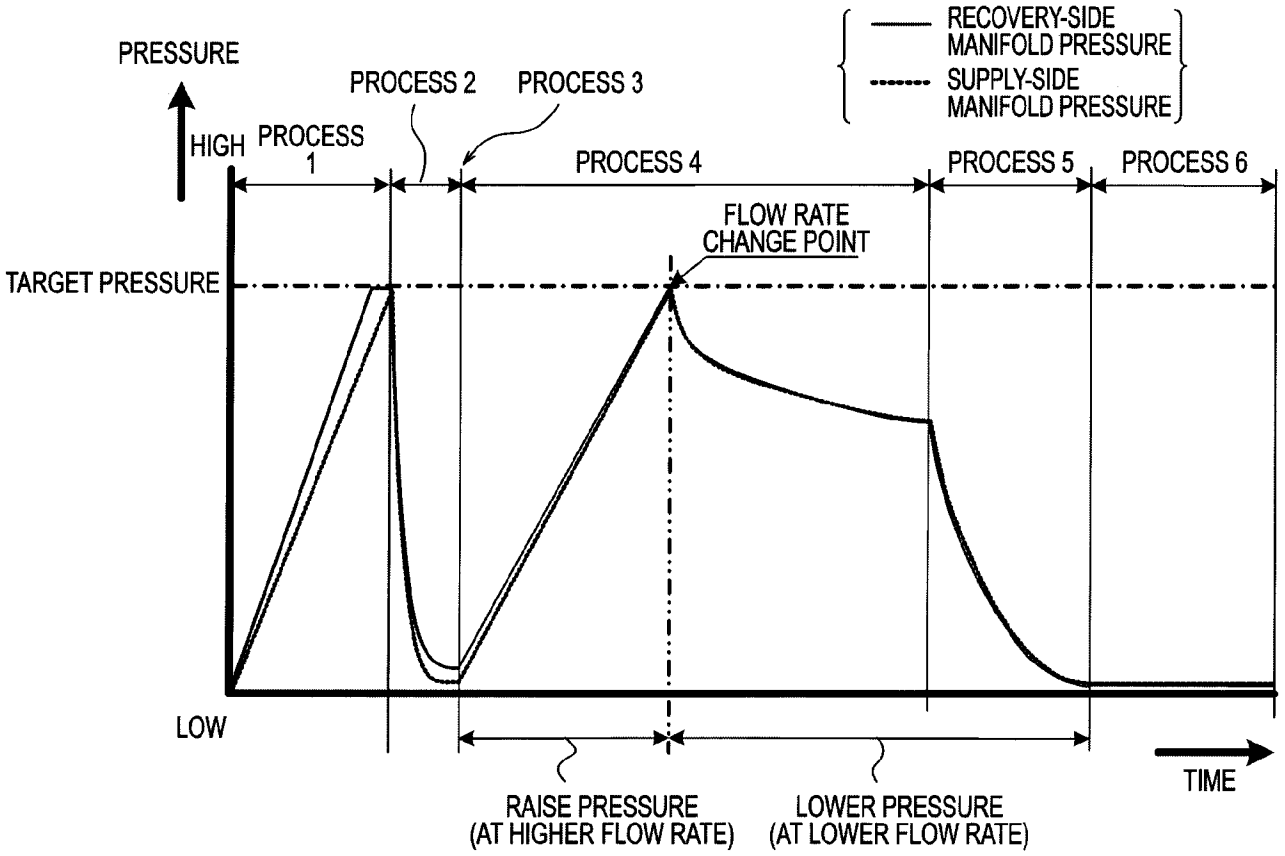
FIG. 14 is a pressure transition characteristic diagram in the respective processes during the pressurization purge control according to Modification 3 of the present exemplary embodiment.

Next, as shown in FIG. 12E, in the process 5, the supply-side drain valve 70 and the recovery-side drain valve 92 are opened, thereby lowering the pressure of each of the supply-side manifold 14, the recovery-side manifold 18 and the reservoir chamber of the head module 12 to the normal pressure. As shown in FIG. 12F, in the process 6, the supply-side drain valve 70 and the recovery-side drain valve 92 are closed to thereby maintain the normal pressure.

(Modification 4)

As shown in FIGS. 15A to 15F, 16, and 17, in Modification 4, the pressurization purge control in 6 processes is performed. FIG. 15 shows the opening and closing patterns of the respective valves in the respective processes.

Figure 15A:
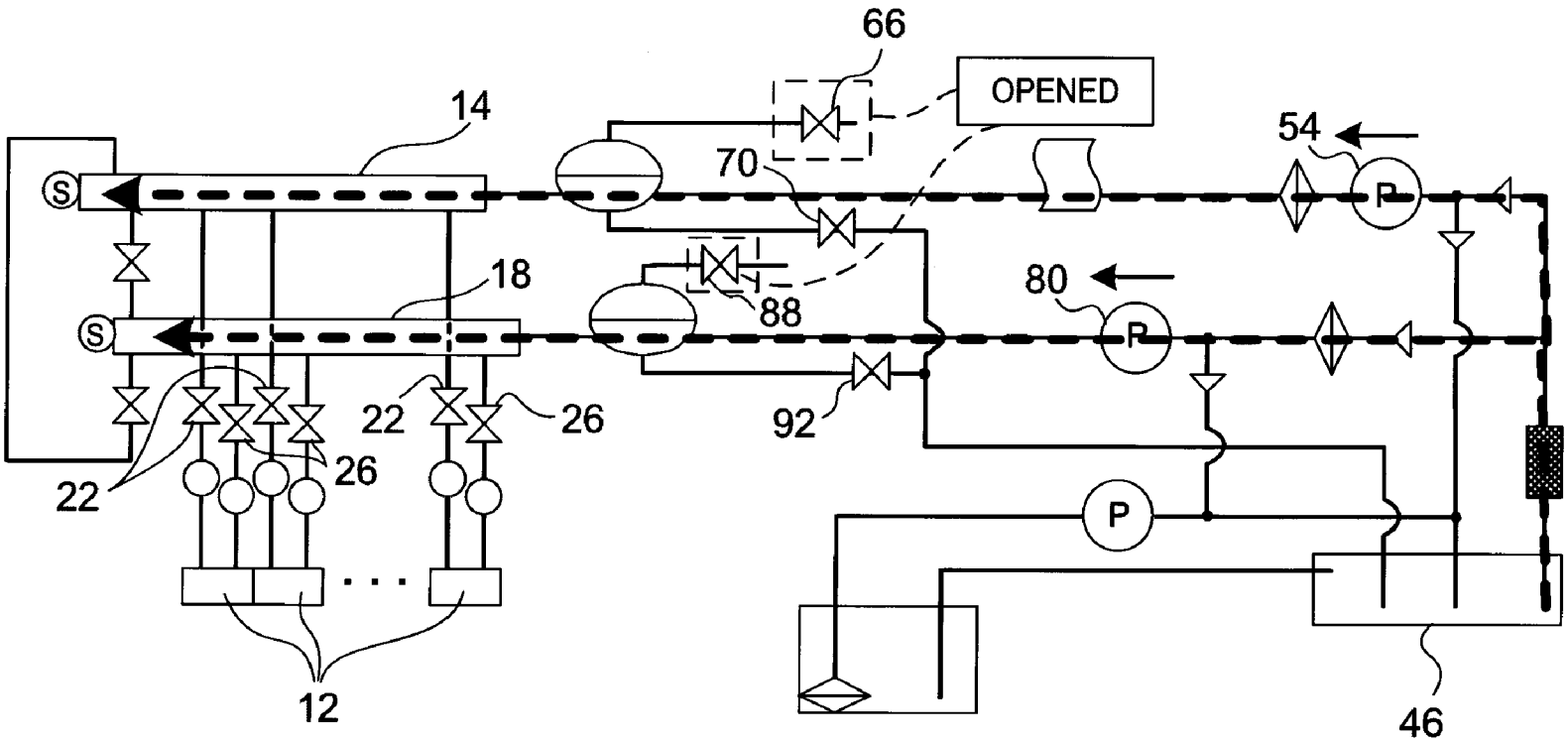
FIGS. 15A to 15F are diagrams of flow paths ensured by the valve opening and closing during the pressurization purge control according to Modification 4 of the present exemplary embodiment, FIG. 15A showing the flow path in a process 1, FIG. 15B showing the flow path in a process 2, FIG. 15C showing the flow path in a process 3, FIG. 15D showing the flow path in a process 4, FIG. 15E showing the flow path in a process 5, and FIG. 15F showing the flow path in a process 6.
Figure 15B:
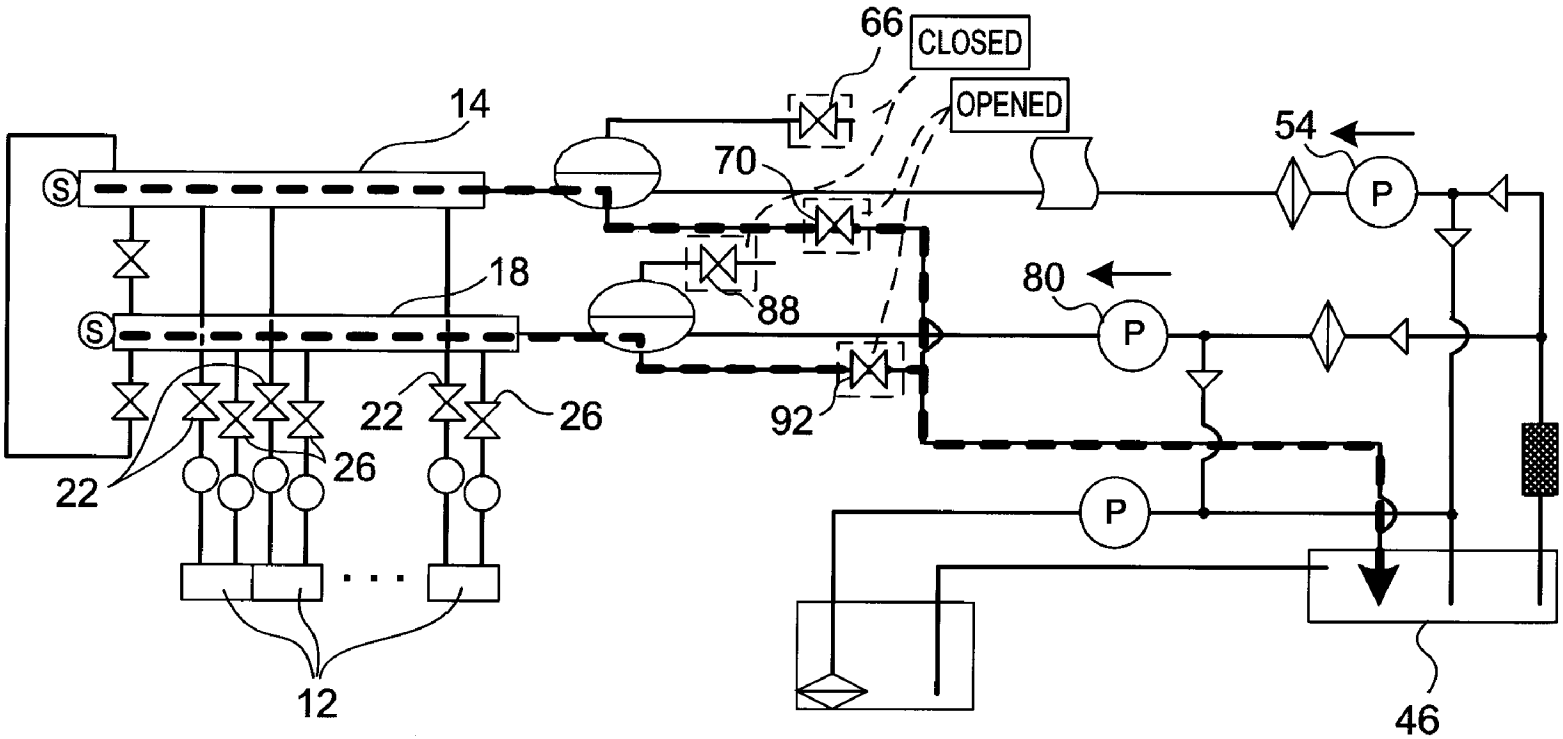

Since the process 1 in FIG. 15A and the process 2 in FIG. 15B are the same as the processes in Modification 3, the process 3 and later will be described, and descriptions of the others will be omitted.

Figure 15C:
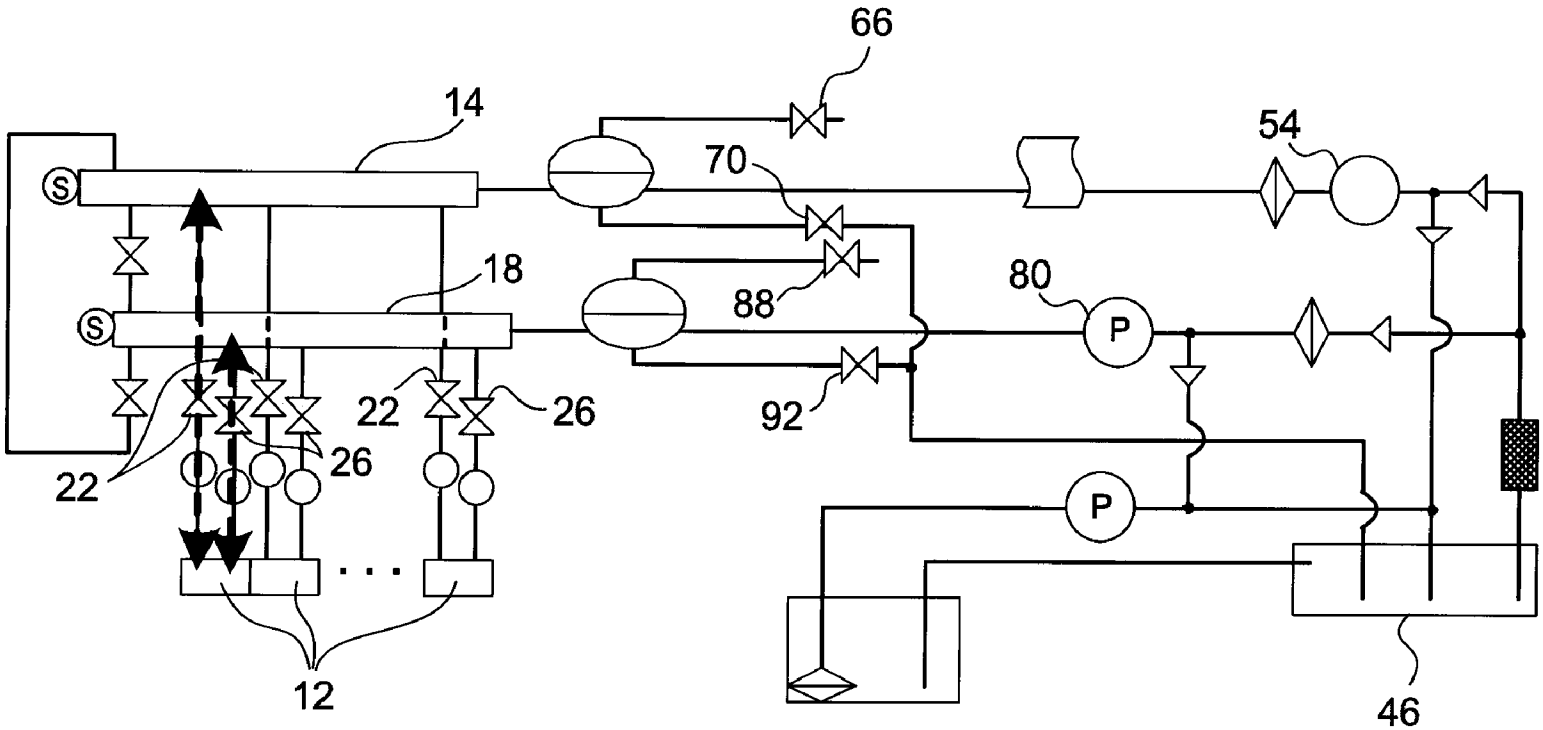

As shown in FIG. 15C, in the process 3, the supply-side valve 22, the recovery-side valve 26 and the recovery-side drain valve 92 are opened. The process 3 corresponds to a line between the process 2 and the process 4, although not shown in FIG. 17.

Figure 15D:
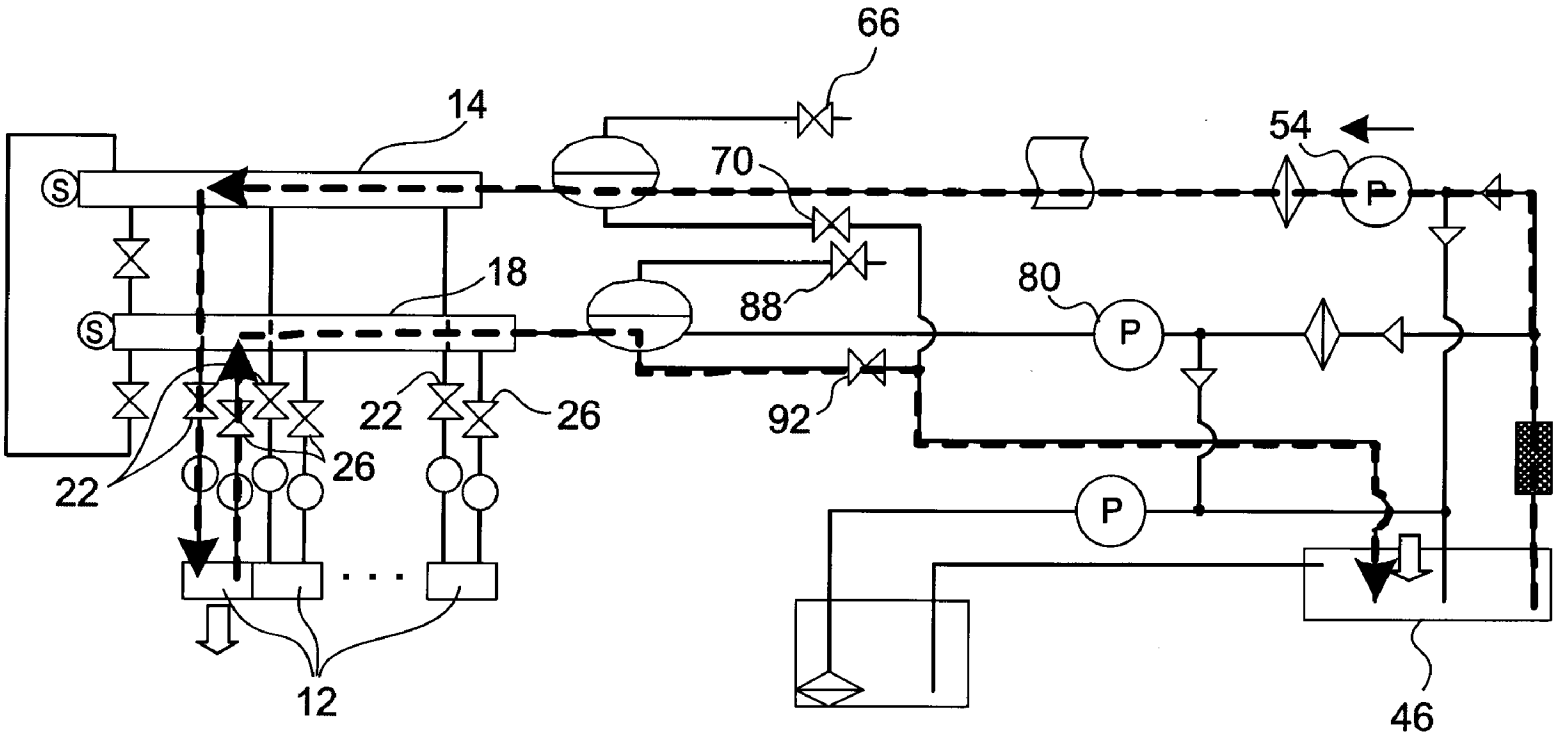

Subsequently, as shown in FIG. 15D, in the process 4, the supply-side pump 54 is driven at the flow rate 1 equivalent to the flow rate 1 in the above-described exemplary embodiment while maintaining the opening and closing state of the respective valves in the process 3. As a result, the ink flows in the order of the supply-side manifold 14→>the reservoir chamber of the head module 12→>the recovery-side manifold 18. At this time, the pressure of the supply-side manifold 14 on the upstream side of the reservoir chamber of the head module 12 becomes larger than the pressure of the recovery-side manifold 18 on the downstream side of the reservoir chamber of the head module 12, thereby causing a pressure difference, and as a result, the ink inside the reservoir chamber of the head module 12 is ejected to the buffer tank 46 through the recovery-side manifold 18.

This flow allows the air bubbles having relatively large diameters in the reservoir chamber of the head module 12 to be recovered in the buffer tank 46.

Thereafter, at a point when the target pressure is reached, the flow rate by the supply-side pump 54 is changed from the flow rate 1 to the flow rate 2 (<flow rate 1), by which the pressure of each of the supply-side manifold 14, the recovery-side manifold 18, and the reservoir chamber of the head module 12 is lowered at the relatively moderate pressure change rate.

The process 4 in Modification 3 has a function similar to that of the process 6 described in the above-described exemplary embodiment.

Figure 15E:
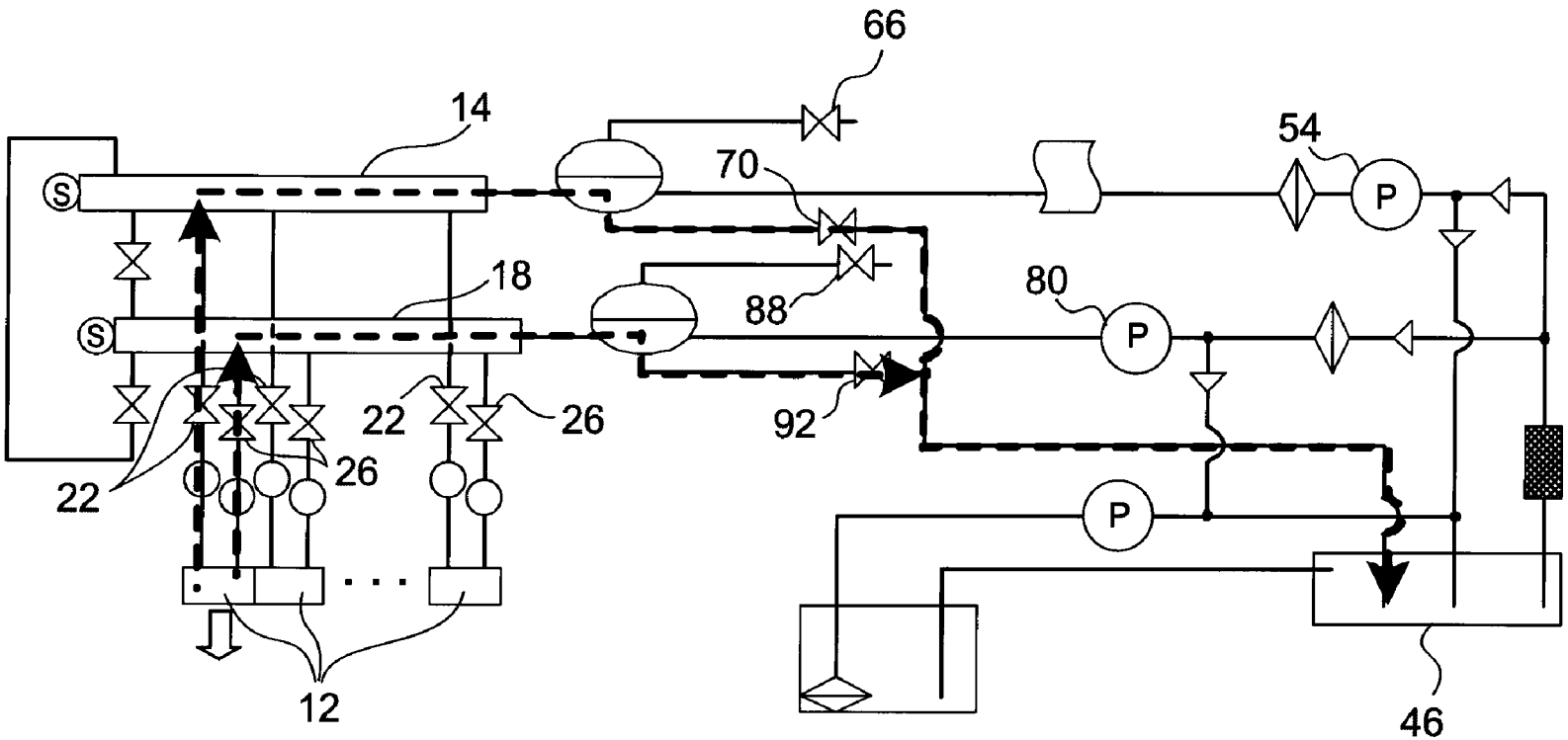
Figure 15F:
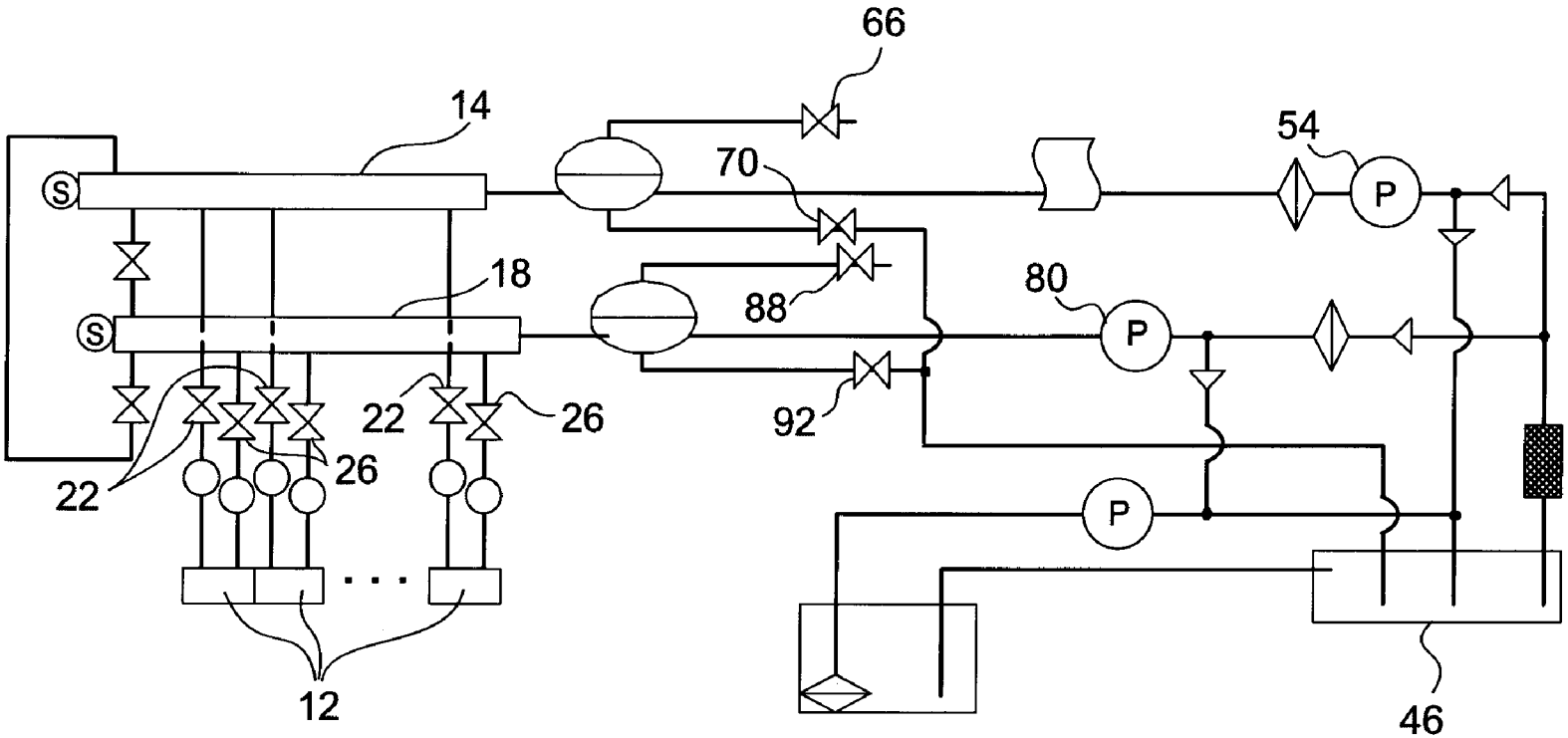
Figure 17:
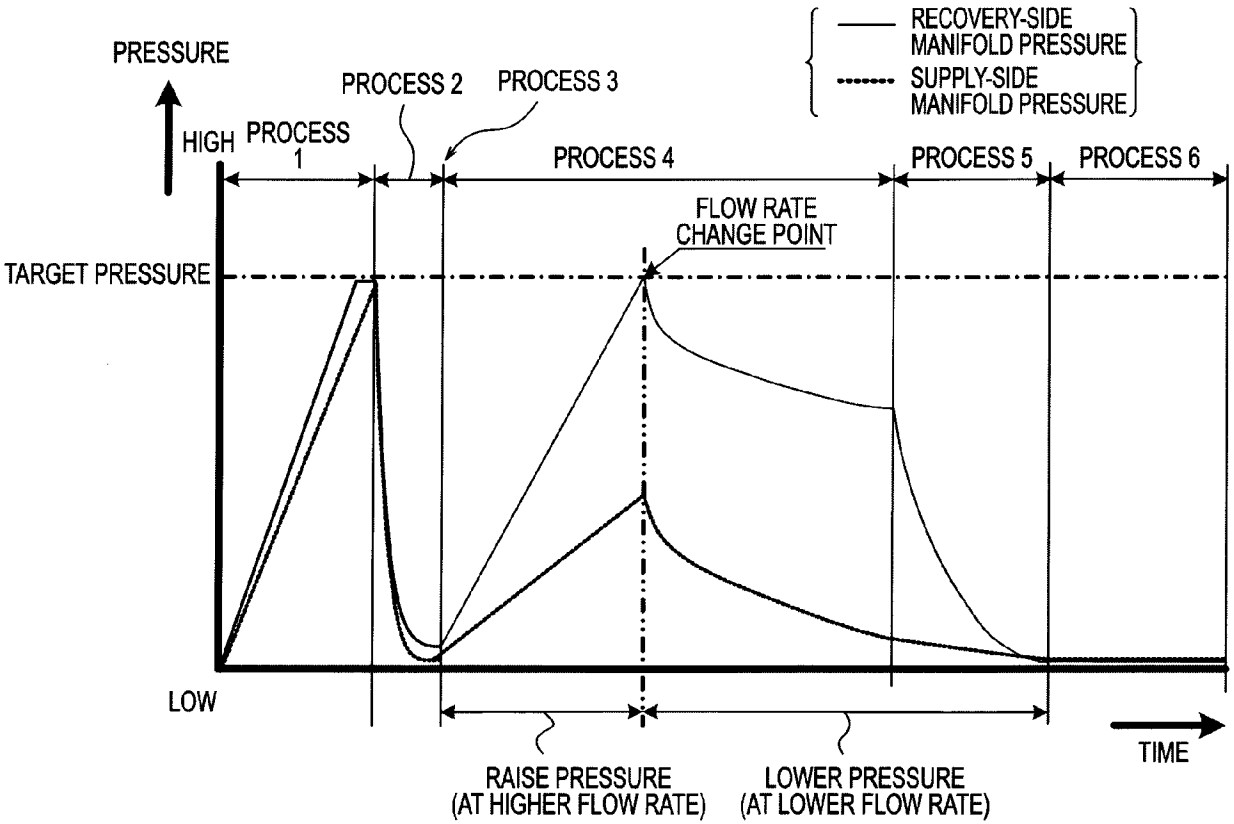
FIG. 17 is a pressure transition characteristic diagram in the respective processes during the pressurization purge control according to Modification 4 of the present exemplary embodiment.

Next, as shown in FIG. 15E, in the process 5, the supply-side drain valve 70 is opened, thereby lowering the pressure of each of the supply-side manifold 14, the recovery-side manifold 18 and the reservoir chamber of the head module 12 to the normal pressure. As shown in FIG. 15F, in the process 6, the supply-side drain valve 70 and the recovery-side drain valve 92 are closed to thereby maintain the normal pressure.

As characteristics of Modification 4, it is predicted that there are air bubbles having relatively large diameters and small diameters (a predetermined reference diameter may be set as a threshold value), so that the air bubbles having larger diameters are returned to the buffer tank 46 and the air bubbles having smaller diameters are ejected from the nozzles. Thus, an ink ejection amount from the nozzles is reduced, as compared with the above-described exemplary embodiment and Modifications 1 to 3.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to be suited to the particular use contemplated. It is intended that the scope of the invention be defined by the following claims and their equivalents.

What is claimed is:

1. A flow rate control device comprising:

a pressure generating unit that delivers a liquid to a liquid reservoir unit comprising an ejecting port; and a flow rate control unit that controls the flow rate of the pressure generating unit by performing a first flow rate control and a second flow rate control, the first flow rate control being to raise a pressure inside the liquid reservoir unit up to a target pressure at a first pressure change rate which is sufficiently high to float air bubbles adhering to a wall surface inside the liquid reservoir unit, and the second flow rate control being to maintain the target pressure or to lower the pressure inside the liquid reservoir unit from the target pressure at a second pressure change rate which is lower than the first pressure change rate in order to eject air bubbles floating inside the liquid reservoir unit from the ejecting port.

2. The flow rate control device according to claim 1, wherein the first flow rate control and the second flow rate control are alternately repeated.

3. The flow rate control device according to claim 1, wherein the flow rate control unit further performs a third flow rate control that is to raise the pressure inside the liquid reservoir unit up to the target pressure at a third pressure change rate which is larger than the second pressure change rate when the pressure inside the liquid reservoir unit is lowered to a predetermined pressure by the second flow rate control, and wherein after the target pressure is reached by the first flow rate control, the second flow rate control and the third flow rate control are alternately repeated.

4. The flow rate control device according to claim 1, wherein a plurality of the liquid reservoir units are connected to a circulation route of the liquid in parallel, and the flow rate of the pressure generating unit is set in accordance with a number of the liquid reservoir units connected in parallel.

5. The flow rate control device according to claim 1, wherein opening and closing control of a pipeline through which the liquid circulates allows relatively coarse air bubbles to be guided to the pipeline together with the liquid and relatively fine air bubbles to be ejected from the ejecting port.

6. The flow rate control device according to claim 1, wherein a pressure adjustor to adjust a pressure inside a pipeline is provided in the pipeline through which the liquid circulates, and a pressure adjustment function of the pressure adjustor is stopped to control the flow rate of the pressure generating unit.

7. A liquid-droplet ejecting device comprising:

a liquid-droplet ejecting control unit comprising a liquid reservoir unit having an ejecting port that ejects liquid droplets, a supply-side pipeline unit formed with a supply route that supplies a liquid from a tank where the liquid which is an aggregate of the liquid droplets is reserved to the liquid reservoir unit by driving a supply-side pressure generating unit, and a recovery-side pipeline unit that recovers the liquid supplied to the liquid reservoir unit to the tank by driving a recovery-side pressure generating unit, the liquid-droplet ejecting control unit controlling the ejecting of the liquid droplets from the ejecting port based on an input signal while maintaining a back pressure of a nozzle at a negative pressure in a standby state; and a flow rate control unit that controls the flow rate of at least one of the supply-side pressure generating unit and the recovery-side pressure generating unit by performing a first flow rate control and a second flow rate control, the first flow rate control being to raise a pressure inside the liquid reservoir unit up to a target pressure at a first pressure change rate which is sufficiently high to float air bubbles adhering to a wall surface inside the liquid reservoir unit, and the second flow rate control being to maintain the target pressure or to lower the pressure inside the liquid reservoir unit from the target pressure at a second pressure change rate which is lower than the first pressure change rate in order to eject air bubbles floating inside the liquid reservoir unit from the ejecting port.

8. The liquid-droplet ejecting device according to claim 7, wherein the first flow rate control and the second flow rate control are alternately repeated.

9. The liquid-droplet ejecting device according to claim 7, wherein the flow rate control unit further performs a third flow rate control that is to raise the pressure inside the liquid reservoir unit up to the target pressure at a third pressure change rate which is larger than the second pressure change rate when the pressure inside the liquid reservoir unit is lowered to a predetermined pressure by the second flow rate control, and wherein after the target pressure is reached by the flow rate control, the second flow rate control and the third flow rate control are alternately repeated.

10. The liquid-droplet ejecting device according to claim 7, wherein a plurality of the liquid reservoir units are connected to a circulation route of the liquid in parallel, and the flow rate of at least one of the supply-side pressure generating unit and the recovery-side pressure generating unit is set in accordance with a number of the liquid reservoir units connected in parallel.

11. The liquid-droplet ejecting device according to claim 7, wherein opening and closing control of a pipeline through which the liquid circulates allows relatively coarse air bubbles to be guided to the pipeline together with the liquid and relatively fine air bubbles to be ejected from the ejecting port.

12. The liquid-droplet ejecting device according to claim 7, wherein a pressure adjustor to adjust the pressure inside a pipeline is provided in the pipeline through which the liquid circulates, and a pressure adjustment function of the pressure adjustor is stopped to control the flow rate of at least one of the supply-side pressure generating unit and the recovery-side pressure generating unit.

13. A non-transitory computer readable medium storing a program causing a computer to execute flow rate control processing of a flow rate control device that comprises a pressure generating unit that delivers a liquid to a liquid reservoir unit comprising an ejecting port, the flow rate control processing comprising:

performing a first flow rate control of controlling the flow rate of the pressure generating unit, the first flow rate control being to raise a pressure inside the liquid reservoir unit up to a target pressure at a first pressure change rate which is sufficiently high to float air bubbles adhering to a wall surface inside the liquid reservoir unit; and performing a second flow rate control of controlling the flow rate of the pressure generating unit, the second flow rate control being to maintain the target pressure or to lower the pressure inside the liquid reservoir unit from the target pressure at a second pressure change rate which is lower than the first pressure change rate in order to eject air bubbles floating inside the liquid reservoir unit from the ejecting port.

14. The non-transitory computer readable medium according to claim 13, wherein the flow rate control processing further comprises alternately repeating the first flow rate control and the second flow rate control.

15. The non-transitory computer readable medium according to claim 13, wherein the flow rate control processing further comprises:

performing a third flow rate control of controlling the flow rate of the pressure generating unit, the third flow rate control being to raise the pressure inside the liquid reservoir unit up to the target pressure at a third pressure change rate which is larger than the second pressure change rate when the pressure inside the liquid reservoir unit is lowered to a predetermined pressure by the second flow rate control, and alternately repeating the second flow rate control and the third flow rate control, after the target pressure is reached by the first flow rate control.

16. The non-transitory computer readable medium according to claim 13, wherein a plurality of the liquid reservoir units are connected to a circulation route of the liquid in parallel, and the flow rate of the pressure generating unit is set in accordance with a number of the liquid reservoir units connected in parallel.

17. The non-transitory computer readable medium according to claim 13, wherein opening and closing control of a pipeline through which the liquid circulates allows relatively coarse air bubbles to be guided to the pipeline together with the liquid and relatively fine air bubbles to be ejected from the ejecting port.

18. The non-transitory computer readable medium according to claim 13, wherein a pressure adjustor to adjust the pressure inside a pipeline is provided in the pipeline through which the liquid circulates, and the flow rate control processing further comprises stopping a pressure adjustment function of the pressure adjustor to control the flow rate of the pressure generating unit.

* * * * *